US007463857B2

(12) United States Patent
Baba et al.

(10) Patent No.: US 7,463,857 B2
(45) **Date of Patent: *Dec. 9, 2008**

(54) FIXING DEVICE WITH PEELING MEMBER FOR AN IMAGE FORMING APPARATUS

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 99 days.

This patent is subject to a terminal disclaimer.

(21) Appl. No.: 11/354,007

(22) Filed: Feb. 15, 2006

(65) Prior Publication Data

US 2007/0048035 A1 Mar. 1, 2007

(30) Foreign Application Priority Data

Aug. 29, 2005 (JP) ..... P2005-248180

(51) Int. Cl.
*G03G 15/20* (2006.01)

(52) U.S. Cl. ..... 399/323

(58) Field of Classification Search ..... 399/322, 399/323, 329

See application file for complete search history.

(56) References Cited

U.S. PATENT DOCUMENTS

2005/0220507 A1* 10/2005 Uehara et al. ..... 399/329
2007/0048042 A1* 3/2007 Uehara et al. ..... 399/329

FOREIGN PATENT DOCUMENTS

JP 03-133871 6/1991
JP 2003-5566 1/2003

* cited by examiner

*Primary Examiner*—David M Gray
*Assistant Examiner*—Ruth N LaBombard
(74) *Attorney, Agent, or Firm*—Morgan, Lewis & Bockius LLP

(57) ABSTRACT

A fixing device for fixing a toner image on a recording material, includes a rotatable endless belt member, a pressure member provided to press into contact and form a nip portion with the belt member, through which the recording material passes, and a peeling member provided downstream of the nip portion, peeling the recording material passed through the nip portion from the belt member by bending the belt member to have different shapes at a widthwise middle portion and at both end portions while the belt member is passing through the peeling member.

21 Claims, 13 Drawing Sheets

FIG. 8

| | SITUATIONS OF PAPER SEPARATION | |
|---|---|---|
| | OK INTERMEDIATE PAPER | OK TOP COATED S PAPER |
| FIXING DEVICE OF THE INVENTION | SUCCESS IN PEELING FOR ALL 50 SHEETS | SUCCESS IN PEELING FOR ALL 50 SHEETS |
| COMPARISON | 25 SEPARATION FAILURES FOR 50 SHEETS | 10 SEPARATION FAILURES FOR 50 SHEETS |

FIXING DEVICE WITH PEELING MEMBER FOR AN IMAGE FORMING APPARATUS

CROSS-REFERENCE TO RELATED APPLICATIONS

This application is based upon and claims the benefit of priority from the prior Japanese Patent Applications No. 2005-248180, filed on Aug. 29, 2005, the entire contents of which are incorporated herein by reference.

BACKGROUND OF THE INVENTION

1. Field of the Invention

The present invention relates to a fixing device or the like to be used in an image forming apparatus utilizing the electronic photography and, more particularly, to a fixing device or the like equipped with a turnable belt member.

2. Description of the Related Art

In the image forming apparatus such as a copier or a printer using the electronic photography, the image formation is performed, as follows. First of all, the surface of a photosensitive element (or a photosensitive drum) formed in a drum shape, for example, is homogeneously charged by a charging device. The photosensitive drum charged is scanned with and exposed to a beam controlled on the basis of image information so that an electrostatic latent image is formed on the surface of the photosensitive drum. Subsequently, the electrostatic image formed on the photosensitive drum is visualized (into a toner image) by a developing device, and the toner image is then conveyed to a transfer unit, as the photosensitive drum rotates, so that it is electrostatically transferred to a sheet of recording paper. The toner image on the recording paper sheet is subjected to a fixing treatment by the fixing device so that the toner image is completed.

As the fixing device used in such image forming apparatus, a structure called the "two-roll type" has been widely utilized in the related art. This two-roll type fixing device is configured such that a fixing roll formed by laminating a refractory elastic layer and a peeling layer on the surface of a cylindrical core having a heat source (or a heater) therein and a pressure roll formed by laminating a core and a peeling layer of a refractory resin coating film or a refractory rubber coating film are pressed to contact with each other. The toner image is fixed by passing the recording paper sheet carrying the unfixed toner image through the pressed contact area (or the nip portion) between the fixing roll and the pressure roll thereby to heat and press the unfixed toner image.

In recent years, many image forming apparatus have spread as the mass production or the coloring of the apparatus has abruptly developed. Therefore, the fixing device mounted on the image forming apparatus also has to be developed more for the high speed.

However, the two-roll type fixing device of the related art has a problem that a sufficient fixing treatment is difficult for a number of sheets of recording paper being continuously sent at a high speed. In the two-roll type fixing device, more specifically, the core composing the fixing roll and the elastic layer of silicone rubber or the like coating the core act as thermal resistors. As a result, the two-roll type fixing device has found it structurally difficult to feed such a calorie instantly and sufficiently from the heater arranged in the fixing roll as corresponds to the calorie to be rubbed by the recording paper sheets from the surface of the fixing roll.

As a result, if the two-roll type fixing device is continuously fed at the high speed with the recording paper sheets, the surface temperature of the fixing roll gradually lowers to cause a disadvantage that the fixing performance is gradually deteriorated. At the rising time of the image forming apparatus, moreover, there easily arises the "temperature drooping phenomenon", in which the surface temperature of the fixing roll temporarily drops. Especially in case thick sheets of paper or the like of a high heat capacity are employed as the recording paper sheets, the calorie to be rubbed from the surface of the fixing roll increases to lower the fixing performance and to enlarge the temperature droop with the result that the image quality is deteriorated by the fixing failure.

In these situations, there has been developed a technique for realizing a fixing device matching the high speed of the image forming apparatus by solving the aforementioned problem which is caused in the case of using the two-roll type fixing device. For example, one technique (as referred to JP-A-3-133871, for example) resides in the fixing device, in which a heating member for heating the recording paper sheets is made of a film-shaped belt member (or a fixing belt) extended by plural tension rolls.

In this fixing device using such fixing belt, the toner image is fixed by heating the fixing belt sufficiently in advance with the heaters arranged in the tension rolls before the fixing belt enters the nip portion, thereby to apply the heat to the recording paper sheets and the toner image at the nip portion from the fixing belt heated. Even if, therefore, the fixing belt is robbed of the heat by the recording paper sheets during the fixing treatment, the fixing belt is enabled to restore a predetermined fixable temperature for a short time period by the heaters in the tension rolls, because the heat capacity of the fixing belt itself is small. In the fixing device using the fixing belt as the heating member, therefore, it is easy to keep the temperature of the fixing belt at the predetermined value when the fixing belt enters the nip portion, and it is possible to feed a sufficient calorie to the nip portion even if the image forming apparatus is speeded up.

In the fixing device using the fixing belt, however, the toner image is carried on the surface of the recording paper sheet, so that the toner image becomes an adhesive to establish a sticking force between the paper sheet and the fixing belt when the toner image is melted by the heat of the fixing belt. This makes it necessary as in the two-roll type fixing device of the related art to provide a mechanism for peeling the paper sheet off the surface of the fixing belt. Especially in case the image forming apparatus is speeded up, when a peeling failure once occurs in the fixing device to cause a paper clogging (or a jamming), many succeeding paper sheets are damaged by the influence of the jamming. This makes it necessary to peel the recording paper sheet having passed the nip portion at the high speed, stably and reliably off the side of the fixing belt.

The mechanism for peeling the paper sheet off the fixing belt surface is configured in the related art such that a peeling pawl is arranged to abut against the fixing belt on the downstream side of the nip portion, as described in JP-A-3-133871. In the fixing device having the configuration, in which a pressure roll is arranged and pressed to contact with the fixing belt looped over the fixing roll and the heating roll under tension, on the other hand, there is used the configuration (as referred to JP-A-2003-5566, for example), in which a fixing member for setting the curvature of the fixing belt at the exit portion (i.e., the most downstream) of the nip portion is disposed on the inner side of the fixing belt at the position corresponding to that exit portion, so that the recording paper sheet is peeled off by the change in the curvature of the fixing belt.

JP-A-3-133871 (page 3, FIG. 3) and JP-A-2003-5566 (pages 6 to 8, FIG. 4) are referred to as related art.

In case, however, the fixing device using the fixing belt employs the separating pawl as the mechanism for peeling the recording paper sheet off the fixing belt surface, the peeling pawl has to be arranged to abut against the fixing belt so that the paper sheet may be stably peeled off from the fixing belt side. If the peeling pawl is used for the peeling action, the fixing belt surface is easily abraded by the peeling pawl. When the abrasion by the peeling pawl occurs on the fixing belt surface, a fixing irregularity corresponding to the abrasion mark in the surface of the fixing belt may be caused on the fixed image thereby to degrade the image quality. Moreover, the offset toner may gradually deposit on the abrasion mark thereby to blot the fixed image. As the abrasion of the surface of the fixing belt proceeds, moreover, the fixing belt of the thin layer may be finally broken to damage the function of the fixing device.

In case, moreover, a fixing member for enlarging the curvature of the fixing belt is disposed as such a mechanism at the exit portion of the nip portion as to peel the recording paper sheet off the fixing belt surface, the fixing belt is pressed onto the pressure roll exclusively by the tension of the fixing belt at an intermediate nip area between the entry portion of the nip portion, in which the fixing roll and the pressure roll are pressed to contact, and the exit portion, in which the fixing member is arranged. As a result, the nip pressure is relatively low in the intermediate nip area. If the recording paper sheet or the toner is heated in such low nip pressure area, the water content in the paper sheet may be gasified into water vapor, or the air in the toner may be thermally expanded to generate air gaps (or air bubbles). In case these air gaps occur, the air bubbles may migrate to disturb the unfixed toner, if the toner on the paper sheet in the nip portion is not completely fixed yet. As a result, the image failure such as the irregularity occurs in the fixed image thereby to cause a serious problem that the degradation of the image quality is invited.

SUMMARY OF THE INVENTION

The present invention has been made in view of the above circumstances and provides a fixing device using a belt material in which a recording paper sheet can be stably separated from the belt member.

The present invention also provides a fixing device capable of keeping a high fixing performance even in the case of speeding up a process of an image forming apparatus including the fixing device.

According to an aspect of the present invention, a fixing device for fixing a toner image on a recording material, includes a rotatable endless belt member, a pressure member provided to press into contact and form a nip portion with the belt member, through which the recording material passes, and a peeling member provided downstream of the nip portion, peeling the recording material passed through the nip portion from the belt member by bending the belt member to have different shapes at a widthwise middle portion and at both end portions while the belt member is passing through the peeling member.

According to another aspect of the present invention, a fixing device for fixing a toner image on a recording material, includes a rotatable endless belt member, a pressure member provided to press into contact and form a nip portion with the belt member, through which the recording material passes, and a peeling member provided downstream of the nip portion, peeling the recording material passed through the nip portion from the belt member with a time difference between a widthwise middle portion and both end portions of the belt member.

According to still another aspect of the present invention, a fixing device for fixing a toner image on a recording material, includes a fixing roll, a belt member wound around the fixing roll to be kept under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member with a time difference between a widthwise middle portion and the both end portions of the belt member.

According to still another aspect of the present invention, a fixing device for fixing a toner image on a recording material, includes a fixing roll, a belt member wound around the fixing roll to be kept under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member by bending the belt member to have different shapes at a widthwise middle portion and at both end portions while the belt member is passing through the peeling member.

According to still another aspect of the present invention, an image forming apparatus includes a toner image forming section which forms a toner image, a transfer section which transfers the toner image formed by the toner image forming section onto a recording material, and a fixing section which fixes the toner image transferred onto the recording material on the recording material. The fixing section includes a fixing roll, a belt member wound around the fixing roll under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member with a time difference between a widthwise middle portion and the both end portions of the belt member.

According to the fixing device and the image forming apparatus, even in the case of speeding up the image forming apparatus, the recording paper sheet can be stably peeled off from the belt member. Moreover, the high fixing performance can be kept to provide many images of a high quality for a short time period.

BRIEF DESCRIPTION OF THE DRAWINGS

FIG. 8 is a diagram showing the evaluation results on a paper separating performance;

DETAILED DESCRIPTION OF THE INVENTION

Embodiments of the invention will be described in detail with reference to the accompanying drawings.

First Embodiment

Figure 1:
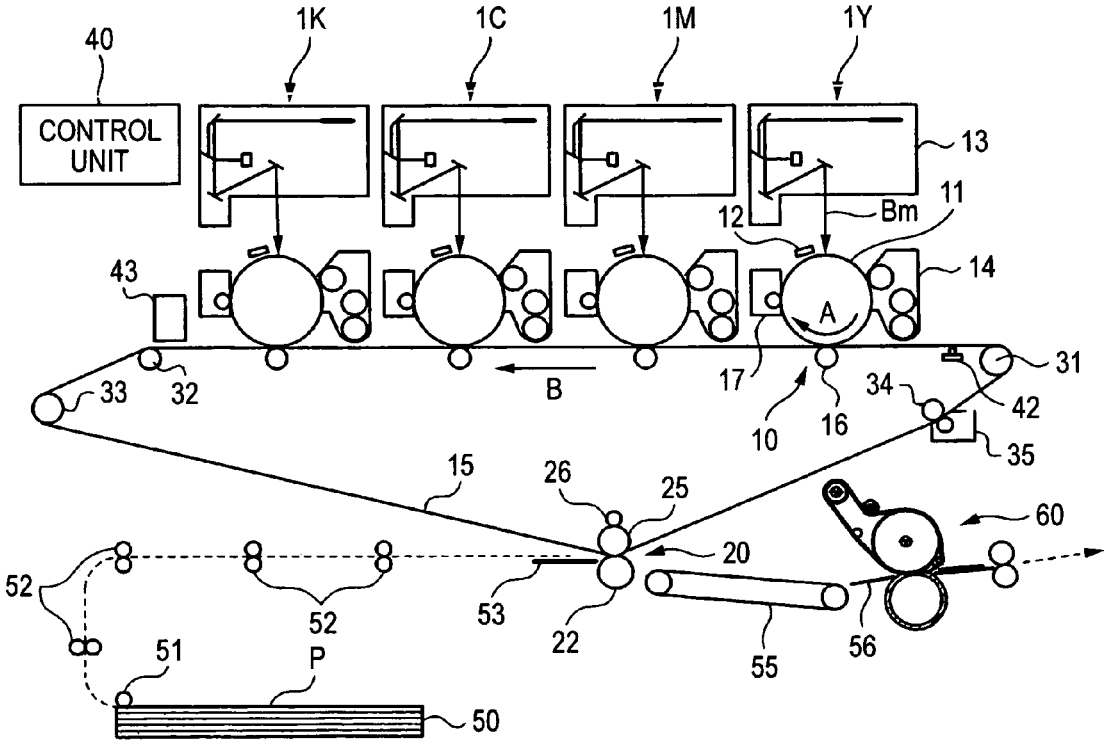
FIG. 1 is a schematic configuration diagram showing an image forming apparatus.

FIG. 1 is a schematic configuration diagram showing an image forming apparatus according to an exemplary embodiment of the present invention. The image forming apparatus shown in FIG. 1 is an intermediate transfer type image forming apparatus, which is generally called the "tandem type". This image forming apparatus is provided with: plural image forming units 1Y, 1M, 1C and 1K for forming toner images of individual color components by the electronic photography; a primary transfer unit 10 for transferring the individual color component toner images formed by the individual image forming units 1Y, 1M, 1C and 1K, sequentially (or primarily) to an intermediate transfer belt 15; a secondary transfer unit 20 for transferring the superposed toner image transferred to the intermediate transfer belt 15, generally (or secondarily) to a paper sheet P or a recording medium (or a recording paper sheet); and a fixing device 60 for fixing the secondarily transferred image to the paper sheet P. Further provided is a control unit 40 for controlling the actions of the individual devices (or the individual units).

In each of the image forming units 1Y, 1M, 1C and 1K, according to this embodiment, a photosensitive drum 11 rotating in the direction of arrow A is surrounded sequentially by electronic photography devices such as a charger 12 for charging the photosensitive drum 11, a laser exposer 13 (having an exposure beam designated by Bm in FIG. 1) for writing an electrostatic latent image on the photosensitive drum 11, a developer 14 reserving the individual color component toners for visualizing the electrostatic latent image on the photosensitive drum 11 with the toners, a primary transfer roll 16 for transferring the individual color component toner images formed on the photosensitive drum 11, to the intermediate transfer belt 15 at the primary transfer unit 10, and a drum cleaner 17 for cleaning the residual toners off the photosensitive drum 11. These image forming units 1Y, 1M, 1C and 1K are arranged substantially straight in the order of Yellow (Y), Magenta (M), Cyan (C) and Black (K) from the upstream side of the intermediate transfer belt 15.

The intermediate transfer belt 15 or the intermediate transfer member is made of a filmed endless belt by containing a proper amount of a charge preventing agent such as carbon black in a resin of polyimide or polyamide. Moreover, the intermediate transfer belt 15 is formed to have a volume resistivity of $10^6$ to $10^{14}$ Ωcm and a thickness of about 0.1 mm. The intermediate transfer belt 15 is circularly driven (or rotated) at a predetermined speed in a direction B, as shown in FIG. 1, by various rolls. As these various rolls, there are arranged: a drive roll 31 driven by the (not-shown) motor excellent in a constant speed for turning the intermediate transfer belt 15; a support roll 32 for supporting the intermediate transfer belt 15 extending substantially straight along the array direction of the individual photosensitive drum 11; a tension roller 33 for applying a constant tension to the intermediate transfer belt 15 and for functioning as a correction roll for prevent the intermediate transfer belt 15 from meandering; a backup roll 25 disposed in the secondary transfer unit 20; and a cleaning backup roll 34 disposed in a cleaning unit for scraping the residual toner on the intermediate transfer belt 15.

The primary transfer unit 10 is composed of the primary transfer roll 16, which is arranged to confront the photosensitive drum 11 across the intermediate transfer belt 15. The primary transfer roll 16 is composed of a shaft, and a sponge layer fixed as an elastomer layer around the shaft. This shaft is a column-shaped rod made of a metal such as SUS. The sponge layer is a spongy cylindrical roll formed of blend rubber of NBS, SBR and EPDM blended with a conducting agent such as carbon black to have a volume resistivity 107 to 109 Ωcm. Moreover, the primary transfer roll 16 is so arranged as is pressed onto the photosensitive drum 11 across the intermediate transfer belt 15 and is fed with a voltage (or a primary transfer bias) of the polarity opposite to the charged polarity (e.g., a minus polarity, as follows) of the toner. As a result, the toner images on the individual photosensitive drums 11 are sequentially electrostatically attracted so that the superposed toner image is formed on the intermediate transfer belt 15.

The secondary transfer unit 20 is composed of a secondary transfer roll 22 arranged on the toner image carrying face side of the intermediate transfer belt 15, and the backup roll 25. This backup roll 25 has a surface made of a tube of blend rubber of EPDM and NBR containing dispersed carbon, and an inside made of EPDM rubber, Moreover, the backup roll 25 is formed to have a surface resistivity of $10^7$ to $10^{10}$ Ω/□ and a hardness set to 70° (ASK C), for example. This backup roll 25 is arranged on the back side of the intermediate transfer belt 15 so that it acts as the opposed electrode of the secondary transfer roll 22. A metallic feeder roll 26, to which a secondary transfer bias is stably applied, is arranged to abut against the backup roll 25.

On the other hand, the secondary transfer roll 22 is composed of a shaft and a sponge layer fixed as an elastomer layer around the shaft. This shaft is a column-shaped rod made of a metal such as SUS. The sponge layer is a spongy cylindrical roll formed of blend rubber of NBS, SBR and EPDM blended with a conducting agent such as carbon black to have a volume resistivity 107 to 109 Ωcm. Moreover, the secondary transfer roll 22 is so arranged as is pressed onto the backup roll 25 across the intermediate transfer belt 15 and is earthed to the ground to generate a secondary transfer bias between itself and the backup roll 25 thereby to transfer the toner image secondarily to the paper sheet P to be transferred to the secondary transfer unit 20.

At the intermediate transfer belt 15 on the downstream side of the secondary transfer unit 20, on the other hand, there is approachably disposed an intermediate transfer belt cleaner 35 for clearing the intermediate transfer belt 15 after the secondary transfer of the residual toners or the paper powder thereby to clean the surface of the intermediate transfer belt 15. On the upstream side of the Yellow image forming unit 1Y, on the other hand, there is arranged a reference sensor (or a home position sensor) 42 for generating a reference signal for the references to take the image forming timing of each of the image forming units 1Y, 1M, 1C and 1K. On the downstream side of the Black image forming unit 1K, on the other hand, there is arranged an image density sensor 43 for adjusting the image quality. This image density sensor 42 recognizes a predetermined mark formed on the back side of the intermediate transfer belt 15, to generate a reference signal so that the individual image forming units 1Y, 1M, 1C and 1K start their image formations on such an instruction from the control unit 40 as based on the recognition of that reference signal.

The image forming apparatus of this embodiment is further provided, as its paper conveyor line, with: a taper sheet tray 50 for reserving the paper sheets P: a pickup roll 51 for taking out and conveying the paper sheets P stacked in the paper sheet tray 50, at a predetermined timing; conveyor rolls 52 for conveying the paper sheet P let off by the pickup roll 51; a conveyor chute for sending the paper sheet P conveyed by the conveyor rolls 52, into the secondary transfer unit 20; a conveyor belt 55 for conveying the paper sheet P secondarily transferred by the secondary transfer roll 22, to the fixing device 60; and a fixing entry guide 56 for guiding the paper sheet P into the fixing device 60.

Here is described a basic imaging process of the image forming apparatus according to this embodiment. In the image forming apparatus, as shown in FIG. 1, image data outputted from the not-shown image reading apparatus (IIT), the not-shown personal computer (PC) or the like is subjected to a predetermined image treatment by the not-shown image processing apparatus (IPS), and its imaging operation is then executed by the image forming units 1Y, 1M, 1C and 1K. The IPS subjects the inputted reflectivity data to predetermined imaging treatments such as a shading correction, a positional registration, a brightness/color space conversion, a gamma correction, a frame clearance or a color edition, or a motion edition. The image data thus image-treated is converted into the color gradation data of the four colors Y, M, C and K.

In accordance with the color gradation data inputted, the laser exposer 13 irradiates the individual photosensitive drums 11 of the image forming units 1Y, 1M, 1C and 1K with the exposing beam Bm emitted from a semiconductor laser, for example. The individual photosensitive drums 11 of the image forming units 1Y, 1M, 1C and 1K have their surfaces charged by the chargers 12 and then scanned and exposed to form the electrostatic latent images. The electrostatic latent images thus formed are developed as the toner images of the individual colors Y, N, C and K by the developers 14 of the individual image forming units 1Y, 1N, 1C and 1K.

The toner images formed on the photosensitive drums 11 of the image forming units 1Y, 1M, 1C and 1K are transferred onto the intermediate transfer belt 15 at the primary transfer unit 10, in which the individual photosensitive drums 11 and the intermediate transfer belt 15 abut. In the primary transfer unit 10, more specifically, the voltage (i.e., the primary transfer bias) of the (plus) polarity opposed to the toner charging polarity is applied to the base material of the intermediate transfer belt 15 by the primary transfer roll 16 so that the primary transfer is carried out by superposing the toner images sequentially on the surface of the intermediate transfer belt 15.

After the toner images were sequentially primary-transferred to the surface of the intermediate transfer belt 15, this intermediate transfer belt 15 moves to convey the toner images to the secondary transfer unit 20. When the toner images are conveyed to the secondary transfer unit 20, the pickup roll 51 in the paper conveying line so rotates as is timed for the toner image to be conveyed to the secondary transfer unit 20, so that the paper sheet P of a predetermined size is fed from the paper sheet tray 50. The paper sheet P fed from the pickup roll 51 is conveyed from the conveyor rolls 52 so that it reaches the secondary transfer unit 20 through the conveyor chute 53. The paper sheet P is once stopped before it reaches the secondary transfer unit 20, and the (not-shown) register roll rotates with the moving timing of the intermediate transfer belt 15 carrying the toner images, so that the paper sheet P and the toner images are positionally registered.

In the secondary transfer unit 20, the secondary transfer roll 22 is pressed onto the backup roll 25 through the intermediate transfer belt 15. At this time, the paper sheet P timed and conveyed is clamped between the intermediate transfer belt 15 and the secondary transfer roll 22. When the voltage (i.e., the secondary transfer bias) of the same (minus) polarity as the charging polarity of the toners is applied from the feeder roll 26, a transfer electric field is established between the secondary transfer roll 22 and the backup roll 25. Then, the unfixed toner images on the intermediate transfer belt 15 are electrostatically transferred altogether onto the paper sheet P at the secondary transfer unit 20, which is pressed by the secondary transfer roll 22 and the backup roll 25.

After this, the paper sheet P having the toner images electrostatically transferred thereto is conveyed as it is separated from the intermediate transfer belt 15 by the secondary transfer roll 22, to the conveyor belt 55 disposed on the downstream side of the secondary transfer roll 22 in the paper conveying direction. The conveyor belt 55 conveys the paper sheet P to the fixing device 60 at the optimum speed matching the conveying speed of the fixing device 60. The unfixed toner images on the paper sheet P conveyed to the fixing device 60 are subjected to heated and pressurizing fixing treatments by the fixing device 60 so that they are fixed on the paper sheet P. The paper sheet P thus having the fixed image formed thereon is conveyed to the (not-shown) discharge tray, which is disposed at the discharge portion of the image forming apparatus.

On the other hand, the residual toners, which are left on the intermediate transfer belt 15 after the transfer to the paper sheet P was ended, are conveyed as the intermediate transfer belt 15 turns, so that they are removed from the intermediate transfer belt 15 by the cleaning backup roll 34 and the intermediate transfer belt cleaner 35.

Here is described the fixing device 60 to be used in the image forming apparatus of this embodiment. This fixing device 60 has a major portion including a fixing belt module 61 presented as one example of the heating member, and a pressure roll 62 presented as one example of a pressure member so arranged as to be pressed onto the fixing belt module 61.

The fixing belt module 61 has a major portion composed of: a fixing belt 610 as one example of a belt member; a fixing roll 611 for rotating while driving the fixing belt 610 under tension; a tension roll 613 for stretching the fixing belt 610 from the inner side; a position correcting roll 614 for correcting the position of the fixing belt 610 between the fixing roll 611 and the tension roll 612; a peeling pad 64 acting as one example of a peeling member arranged in the downstream side area of a nip portion N, in which the fixing belt module 61 and the pressure roll 62 are pressed to contact, and at the position close to the fixing roll 611; and a tension roll 615 for stretching the fixing belt 610 on the downstream side of the nip portion N.

The fixing belt 610 is a flexible endless belt having a peripheral length of 314 mm and a width of 340 mm. Moreover, the fixing belt 610 is composed of: a base layer made of a polyimide resin having a thickness of 80 μm; an elastic layer laid on the surface side (or the periphery side) of the base layer and made of silicon rubber having a thickness of 200 μm; and a peeling layer coating the elastic layer and made of a tube of a copolymer resin (PFA) of tetrafluoroethylene-perfluroalkylvinylether having a thickness of 30 μm. Here, the composition of the fixing belt 610 can select the material, the thickness, the hardness and so on suitably according to the apparatus designing conditions such as the using object or the using condition.

The fixing roll 611 is a cylindrical roll formed of aluminum to have an external diameter of 65 mm, a length of 360 mm and a thickness of 10 mm. Moreover, the fixing roll 611 is rotated at a surface speed of 440 mm/s in the direction of arrow C by the driving force of the not-shown drive motor. Inside of the fixing roll 611, moreover, a halogen heater 616*a* rated at 900 W is arranged as a heat source, so that the control unit 40 (as referred to FIG. 1) of the image forming apparatus controls the surface temperature of the fixing roll 611 to 150° C. on the basis of the measured value of a temperature sensor 617*a*, which is arranged to contact with the surface of the fixing roll 611.

The tension roller 612 is a cylindrical roll formed of aluminum to have an external diameter of 30 mm, a thickness of 2 mm and a length of 360 mm. Inside of the tension roller 612, moreover, a halogen heater 616*b* rated at 1000 W is arranged as a heat source so that the surface of the tension roll 612 is controlled to 190° C. by a temperature sensor 617*b* and the control unit 40 (as referred to FIG. 1). Therefore, the tension roll 612 has not only a function to stretch the fixing belt 610 but also a function a function to heat the fixing belt 610 from the inner peripheral side.

At the two end portions of the tension roll 612, on the other hand, there are arranged the (not-shown) spring members for pressing the fixing belt 610 to the outer side thereby to provide the entire tension of the fixing belt 610 at 15 Kgf. In order to homogenize the tension of the fixing belt 610 in the widthwise direct-ion and to suppress the axial displacement of the fixing belt 610 as small as possible, the tension roll 612 is formed into the so-called "crown" shape, in which the external diameter is made more at the end portions by 100 μm than at the central portion.

The tension roll 613 is a cylindrical roll formed of aluminum to have an external diameter of 25 mm, a thickness of 2 mm and a length of 360 mm. On the surface of the tension roll 613, moreover, there is formed a peeling layer, which is made of PFA to have a thickness of 20 μm. This peeling layer is formed to prevent the slight offset toners or paper powder coming from the outer circumference of the fixing belt 610 from depositing on the tension roll 613. Like the tension roll 612, moreover, the tension roll 613 is formed into the crown shape, in which the external diameter is made larger at the end portions by 100 μm than at the central portion. Here, both the tension roll 612 and the tension roll 613 are formed into the crown shape, but only one of the tension roll 612 and the tension roll 613 may be formed into the crown shape.

Inside of the tension roll 613, a halogen heater 616*c* rated at 1000 W is arranged as a heat source so that the surface temperature is controlled to 190° C. by a temperature sensor 617*c* and the control unit 40 (as referred to FIG. 1). Therefore, the tension roll 613 has not only a function to stretch the fixing belt 610 but also a function to heat the fixing belt 610 from the outer periphery side. In this embodiment, therefore, there is adopted the configuration, in which the fixing belt 610 is heated by the fixing roll 611, the tension roll 612 and the tension roll 613.

The position correcting roll 614 is a cylindrical roll made of aluminum to have an external diameter of 15 μm and a length of 360 mm. In the vicinity of the position correcting roll 614, there is arranged the (not-shown) belt edge position detecting mechanism for detecting the edge positions of the fixing belt 610. In the position correcting roll 614, moreover, there is arranged an axial displacement mechanism for shifting the abutting position of the fixing belt 610 in the axial direction in accordance with the detection result of the belt edge position detecting mechanism, thereby to control the meandering (or the belt walk) of the fixing belt 610.

The peeling pad 64 is a block member made of a rigid material such as a metal of SUS or a resin to have a substantially arcuate cross section. Moreover, the peeling pad 64 is fixed and arranged in the area (i.e., the "roll nip portion N1"), in which the pressure roll 62 is pressed to contact with the fixing roll 611 through the fixing belt 610, that is, all over in the axial direction of the fixing roll 611. Moreover, the peeling pad 64 is disposed to press the pressure roll 62 homogeneously with a predetermined load (e.g., 10 Kgf) through the fixing belt 610 over a predetermined width area (e.g., the width of 2 mm along the advancing direction of the fixing belt 610) thereby to form the later-described "peeling pad nip portion N2" (as referred to FIG. 3).

On the other hand, the tension roll 615 is a cylindrical roll made of aluminum to have an external diameter of 12 mm and a length of 360 mm. Moreover, the tension roll 615 is so arranged close to the peeling pad 64 on the downstream side in the advancing direction of the fixing belt 610 that the fixing belt 610 having passed through the peeling pad 64 may smoothly turn toward the fixing roll 611.

Next, the pressure roll 62 is made of a cylindrical roll 621 of aluminum as a basic material to have a diameter of 45 mm and a length of 360 mm, and is configured by sequentially laminating on the basic material an elastic layer 622 made of silicon rubber having a rubber hardness of 30° (JIS-A) to have a thickness of 10 mm, and a peeling layer made of a PFA tube having a thickness of 100 μm. Moreover, the pressure roll 62 is so disposed as is pressed onto the fixing belt module 61, so that it follows the fixing roll 611 to rotate in the direction of arrow E, as the fixing roll 611 of the fixing belt module 61 rotates in the direction of the arrow C. The advancing speed of the pressure roll 62 is 440 mm/s, which is equal to the surface speed of the fixing roll 611.

Here is subsequently described the nip portion N, at which the fixing belt module 61 and the pressure roll 62 are pressed to contact with each other.

Figure 3:
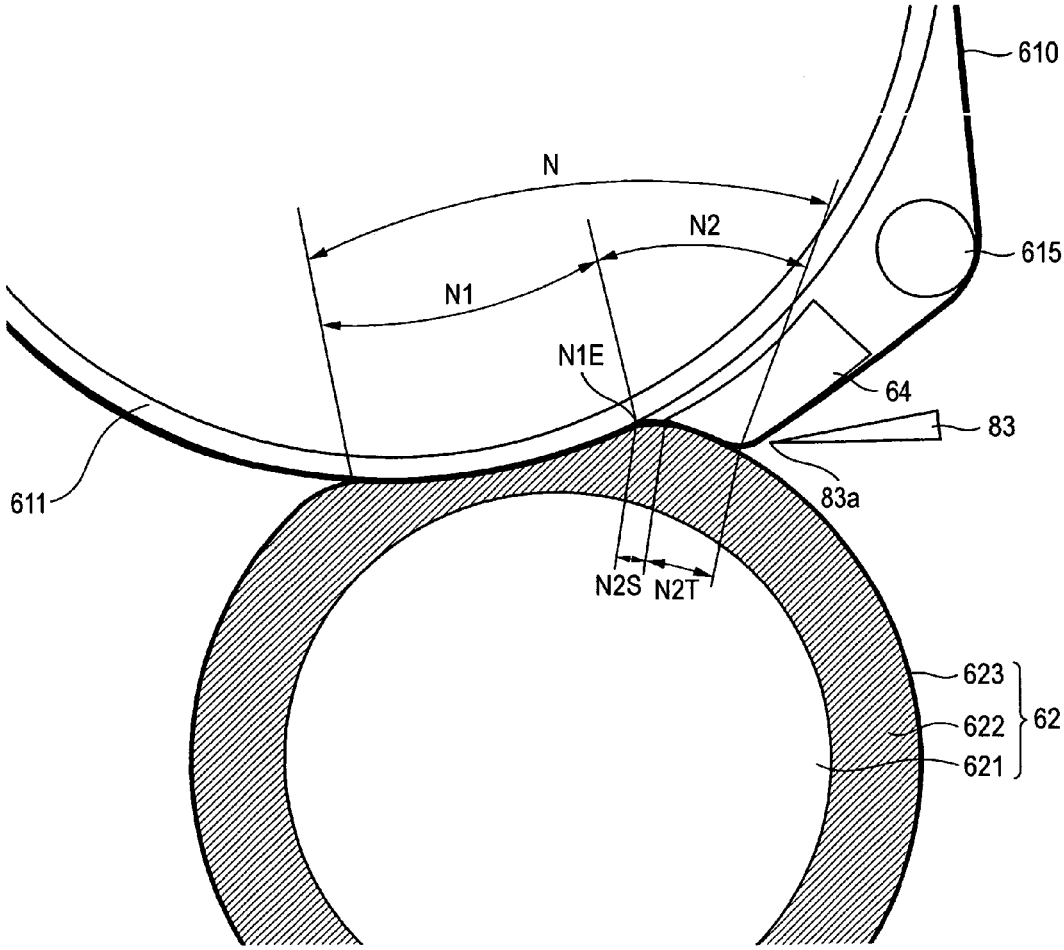
FIG. 3 is a schematic cross section showing an area close to a nip portion.

FIG. 3 presents a schematic cross section showing the near area of the nip portion N. In the nip portion N, in which the fixing belt module 61 and the pressure roll 62 are pressed to contact with each other, as shown in FIG. 3, the pressure roll 62 is pressed to contact with the outer periphery of the fixing belt 610 in the area (or the wrap area), in which the fixing belt 610 is wound on the fixing roll 611, thereby to form the roll nip portion (or the first nip portion) N1.

Here in the fixing device 60 of this embodiment, the fixing roll 611 is the hard roll made of aluminum, and the pressure roll 62 is the soft roll coated with the elastic layer 622. In the roll nip portion N1, therefore, the fixing roll 611 is hardly warped, but only the pressure roll 62 is largely warped only on the surface (that is, the warpage of the pressure roll 62>the warpage of the fixing roll 611) thereby to form the nip area having a predetermined with in the advancing direction of the fixing belt 610.

Thus in the fixing device 60 of this embodiment, the fixing roll 611 on the side, where the fixing belt 610 is wrapped in the roll nip portion N1, is hardly deformed to keep its cylindrical shape. As a result, the fixing belt 610 turns along the circumference of the surface of the fixing roll 611 without having its turning radius fluctuated, so that it can pass through the roll nip portion N1 while keeping the advancing speed constant. Even when, therefore, the fixing belt 610 passes through the roll nip portion N1, the fixing belt 610 is remarkably hardly wrinkled or distorted. As a result, a disturbance is hardly caused in the fixed image so that a fixed image of a high quality can be stably provided. Here in the fixing device 60 of this embodiment, the roll nip portion N1 is set to a width of 15 mm along the advancing direction of the fixing belt 610.

In the vicinity of the downstream side of the roll nip portion N1, moreover, there is arranged the peeling pad 64, which presses the fixing belt 610 onto the surface of the pressure roll 62. On the downstream side and continuously of the roll nip portion N1, therefore, there is formed the peeling pad nip portion (or the second nip portion) N2, at which the fixing belt 610 is wrapped by the surface of the pressure roll 62.

As shown in FIG. 3, the peeling pad 64 forming the peeling pad nip portion N2 is formed to have a substantially arcuate cross section and is arranged close to the downstream side of the roll nip portion N1 and along the axial direction of the fixing roll 611. The fixing belt 610 having passed through the peeling pad nip portion N2 turns to follow the side face of the peeling pad 64. As a result, the advancing direction of the fixing belt 610 is abruptly changed or bent toward the tension roll 615 by the peeling pad 64. As a result, the paper sheet P having passed through the roll nip portion N1 and the peeling pad nip portion N2 cannot accompany the change of the fixing belt 610 in the advancing direction at the instant when it leaves the peeling pad nip portion N2, so that the paper sheet P is peeled off from the fixing belt 610 by its own so-called "nerve". Thus, the paper sheet P is stably separated with the curvature at the exit portion of the peeling pad nip portion N2. Here in the fixing device 60 of the embodiment, the peeling pad nip portion N2 is set to have a width of 2.5 mm along the advancing direction of the fixing belt 610.

Here are specifically described the peeling pad 64 and the peeling pad nip portion N2 formed by the peeling pad 64.

The peeling pad 64 is arranged in the vicinity of the downstream side of the roll nip portion N1, as described above. In the nip portion N composed of the roll nip portion N1 and the peeling pad nip portion N2, therefore, a valley area, in which the nip pressure drops to a predetermined or lower level, is prevented from occurring in the area from the position (as hereinafter referred to FIG. 4 and FIG. 5) where the nip pressure takes the peak in the roll nip portion N1 to the most downstream position of the peeling pad nip portion N2, so that the nip pressure can be set to lower continuously uniformly. As a result, the fixing device 60 of this embodiment can realize the stable paper sheet separation and can have a high quality without an image deterioration such as an image irregularity. A first description is made on the point that the area of the valley, in which the nip pressure drops to the predetermined or lower level, is prevented by the peeling pad 64 from occurring so that the nip pressure is continuously and uniformly lowered in the nip portion N.

In the fixing device 60 of this embodiment, there is used the fixing belt module 61, which is configured so that the fixing belt 610 is supported under tension as the heating member by the plural rolls including the fixing roll 611. This configuration using the fixing belt module 61 has such excellent advantages that the fixing device 60 can be always kept at the predetermined fixing temperature even in the case of speeding up the image forming apparatus, and so that the occurrence of the so-called "temperature drooping phenomenon", in which the fixing temperature drops at the time of starting the high-speed fixing action, can be suppressed.

In this fixing device 60 using the fixing belt module 61, however, the toner images are carried on the surface of the paper sheet P, so that they act as an adhesive to establish a sticking force between the paper sheet P and the fixing belt 610 when they are melted by the heat of the fixing belt 610. This makes it necessary, as in the fixing device of the related art, to provide a mechanism for peeling the paper sheet P from the surface of the fixing belt 610. Especially in the case of speeding up the image forming apparatus, the paper clogging (or the jamming), if once caused in the fixing device 60 by the peeling failure, influences the number of succeeding paper sheets P to increase. This makes it necessary to peel the paper sheet P having passed at a high speed through the nip portion N, stably and reliably off the side of the fixing belt 610.

If the separating pawl of the related art is then used as the mechanism for peeling the paper sheet P off the surface of the fixing belt 610, it is necessary for peeling the paper sheet P stably off the side of the fixing belt 610 that the separating pawl is arranged to abut against the fixing belt 610. In the case of using the separating pawl, therefore, the fixing belt 610 is liable to have its surface worn by the separating pawl thereby to cause the following problems. Specifically, an abrasion mark may be formed in the surface of the fixing belt 610 by the separating pawl, and a fixing irregularity corresponding to the abrasion mark in the surface of the fixing belt 610 may be caused on the fixed image thereby to degrade the image quality. Alternatively, the offset toners may gradually deposit on the abrasion mark thereby to blot the fixed image. As the abrasion of the surface of the fixing belt 610 proceeds, moreover, the fixing belt 610 of the thin layer may be finally broken to damage the function of the fixing device 60. For the paper sheet separation in the fixing belt module 61 using the fixing belt 610, therefore, the most proper one is the aforementioned peeling mechanism according to the curvature separation requiring no abutting member such as the separating pawl.

In the fixing belt module 61 of this embodiment, therefore, the peeling pad 64, i.e., the member for changing the advancing direction of the fixing belt 610 abruptly is arranged in the downstream portion of the nip portion N.

If the peeling pad nip portion N2 is formed to continue to the roll nip portion N1 by arranging the peeling pad 64, a boundary area N2S (as referred to FIG. 3), which is located closer to the side of the roll nip portion N1 than an area (i.e., the pressed contact portion between the peeling pad 64 and the pressure roll 62) having the peeling pad 64 in the peeling pad nip portion N2, does not have any member that presses the fixing belt 610 directly onto either the fixing roll 611 or the pressure roll 62. In this boundary area N2S, therefore, the paper sheet P is pressed to contact with the pressure roll 62 exclusively by the tension of the fixing belt 610 so that the nip pressure (as will be called the "Pn" in the boundary area N2S) in that boundary area N2S is built up only by the tension of the fixing belt 610. If, therefore, the peeling pad 64 is arranged at a spacing of a predetermined or more distance from a downstream side end portion N1E (as referred to FIG. 3) of the roll nip portion N1, the nip pressure Pn of the boundary area N2S is such a valley area between the nip pressure of the roll nip portion N1 and the nip pressure of an area N2T having the peeling pad 64 that it is lower than a predetermined value (i.e., Pn1). Moreover, the nip pressure Pn in the boundary area N2S is lower than the nip pressure in the roll nip portion N1 and the nip pressure of the are N2T having the peeling pad 64.

Figure 4:
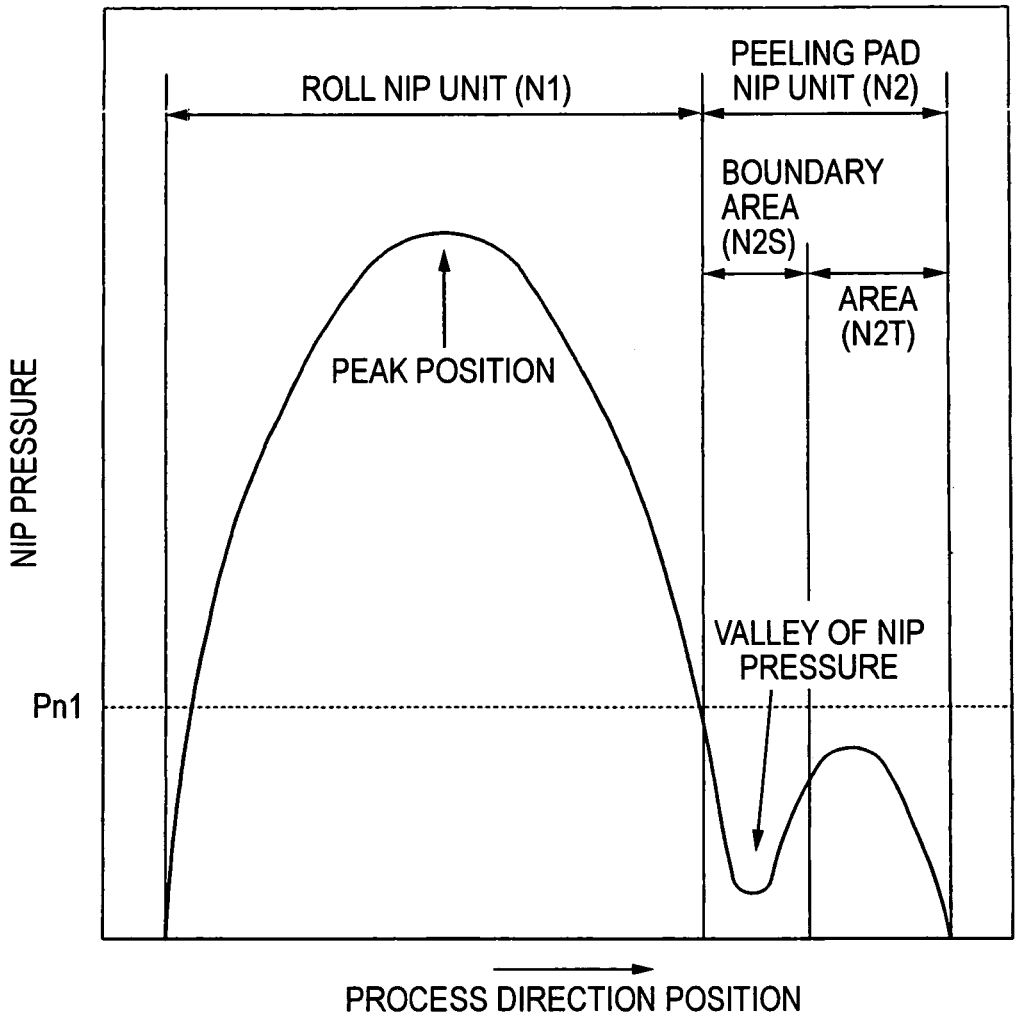
FIG. 4 is a diagram schematically showing a nip pressure distribution of the nip portion of the case, in which a peeling pad is arranged at a predetermined or more spacing from a roll nip portion.

Here, FIG. 4 is a diagram schematically showing a nip pressure distribution in the nip portion N (composed of the roll nip portion N1 and the peeling pad nip portion N2) of the case, in which the peeling pad 64 is arranged at a spacing of a predetermined or more distance from the downstream side end portion N1E of the roll nip portion N1). In this case, as shown in FIG. 4, the valley area having the nip pressure Pn dropped to the predetermined or lower value Pn1 is formed in the boundary area N2S in the peeling pad nip portion N2 from the roll nip portion N1.

Here in the fixing process of the fixing device 60 of this embodiment, the paper sheet P carrying the toner images is heated and pressed in the roll nip portion N1 so that the toners are melted and bonded. At this time, from the paper sheet P or the toners having received the heat in the roll nip portion N1, the moisture in the paper sheet P will be gasified to generate water vapor, or the air in the toners will be thermally expanded. However, the high nip pressure is applied in the roll nip portion N1 so that air gaps (or air bubbles) are not generated by the water vapor or the expanded air between the fixing belt 610 and the pressure roll 62.

If, however, the nip pressure Pn in the boundary area N2S in the peeling pad nip portion N2 from the roll nip portion N1 is set in the state at the predetermined or lower value Pn1, the air bubbles compressed in the roll nip portion N1 cannot be suppressed but are released in the boundary area N2S. If, moreover, the paper sheet P having the bubbles advances into the high nip pressure area N2T having the peeling pad 64, the air bubbles released in the boundary area N2S are caused by that high nip pressure to migrate on the surface of the paper sheet P. Then, the toner images on the paper sheet P are disturbed by the migrating air bubbles, because they have just passed through the roll nip portion N1 so that the molten toners are not completely solidified yet. This invites an event that the irregularities are caused in the fixed image.

Figure 5:
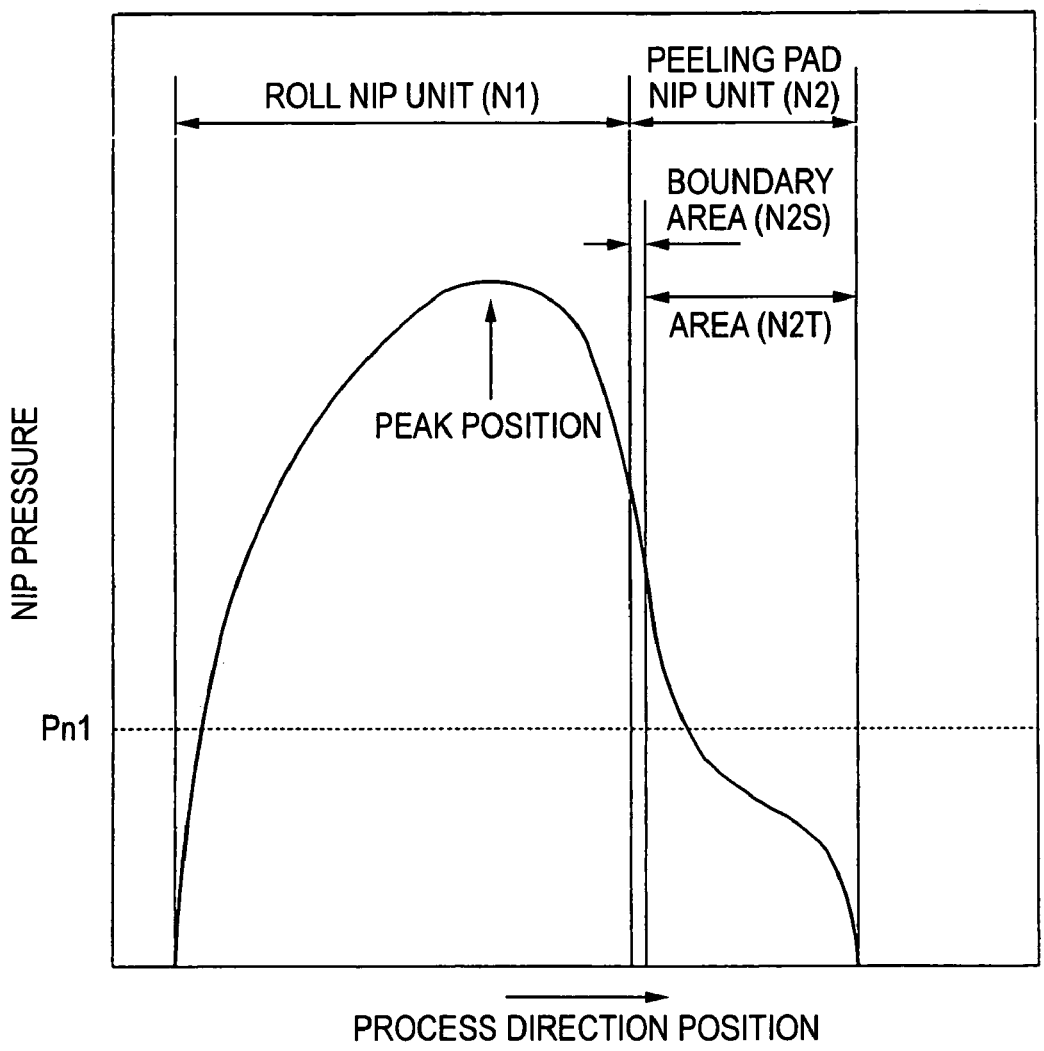
FIG. 5 is a diagram schematically showing a nip pressure distribution of the case, in which the peeling pad is arranged close to the downstream side of the roll nip portion.

In the fixing device 60 of this embodiment, therefore, the peeling pad 64 is arranged in the vicinity of the downstream side of the roll nip portion N1. This arrangement of the peeling pad 64 makes it possible to make as narrow as possible the width of the boundary area N2S between the roll nip portion N1 in the peeling pad nip portion N2 and the area N2T having the peeling pad 64 arranged therein. This narrows the area, in which the paper sheet P is pressed to contact with the pressure roll 62 exclusively by the tension of the fixing belt 610. As shown in FIG. 5 (which schematically shows the nip pressure distribution of the case, in which the peeling pad 64 is arranged in the vicinity of the downstream side of the roll nip portion N1), therefore, the boundary area N2S can suppress the formation of the valley area, in which the nip pressure Pn might otherwise drop lower than the predetermined value Pn1. Moreover, the nip pressure can be set to become continuously and uniformly lower in the area of the nip portion from the position, in which the nip pressure takes the peak in the roll nip portion N1, to the most downstream position of the peeling pad nip portion N2.

Thus, the nip pressure Pn in the boundary area N2S can be set higher than the predetermined value Pn1 thereby to suppress the generation of air bubbles in the boundary area N2S. Moreover, the nip pressure is set continuously and uniformly lower from the position having the peak nip pressure in the roll nip portion N1 to the most downstream position of the peeling pad nip portion N2. As a result, either the water vapor held in the high nip pressure in the roll nip portion N1 or the air to be thermally expanded is gradually released in the route till it passes through the peeling pad nip portion N2, so that the occurrence of the migration phenomenon of the air bubbles can be suppressed. As a result, the toner images in the state where they are not completely solidified yet are hardly disturbed so that the fixed image can be preventing from becoming irregular.

Here, the pressure (i.e., the nip pressure) Pn in the boundary area N2S is needed to satisfy the following Equation (1) for suppressing the generation of the air bubbles in the boundary area N2S:

$$Pn \geqq Po \times (Tn/To - 1) \quad (1).$$

Specifically, the predetermined value Pn1 of the nip pressure Pn in the boundary area N2S is expressed by:

$$Pn1 = Po \times (Tn/To - 1).$$

Here: Tn an absolute temperature of the fixing belt 610; To an absolute temperature (or an environmental temperature) at a position sufficiently spaced from the fixing roll 611; and Po the atmospheric pressure.

Equation (1) is derived, as follows. At first, the equation of state of an ideal gas is expressed by the following Equation (2):

$$PV = nRT \quad (2).$$

Here: P a pressure; V a volume; n the number of moles; R a gas constant; and T an absolute temperature.

Hence, the following Equations (3) and (4) are derived:

$$(Po + Pn) \times Vn = nRTn \quad (3);$$

and $$PoVo = nRTo \quad (4).$$

Here: Vn the volume of air bubbles in the boundary area N2S; and Vo the volume of air bubbles under the atmospheric pressure.

For suppressing the generation of air bubbles in the boundary are N2S, it is sufficient to satisfy the condition of $Vn \geqq Vo$. From Equation (3) and Equation (4), therefore, the following Equation (5) is derived:

$$Tn/(Po + Pn) \geqq To/Po \quad (5).$$

Equation (5) is modified to derive the aforementioned Equation (1).

The peeling pad 64 is so arranged at the position close to the downstream side of the roll nip portion N1 that the boundary area N2S may be made sufficiently narrow for the nip pressure Pn to satisfy Equation (1).

Subsequently, here is described the peeling pad 64 which is so shaped as can be arranged close to the downstream side of the roll nip portion N1.

Figure 6:
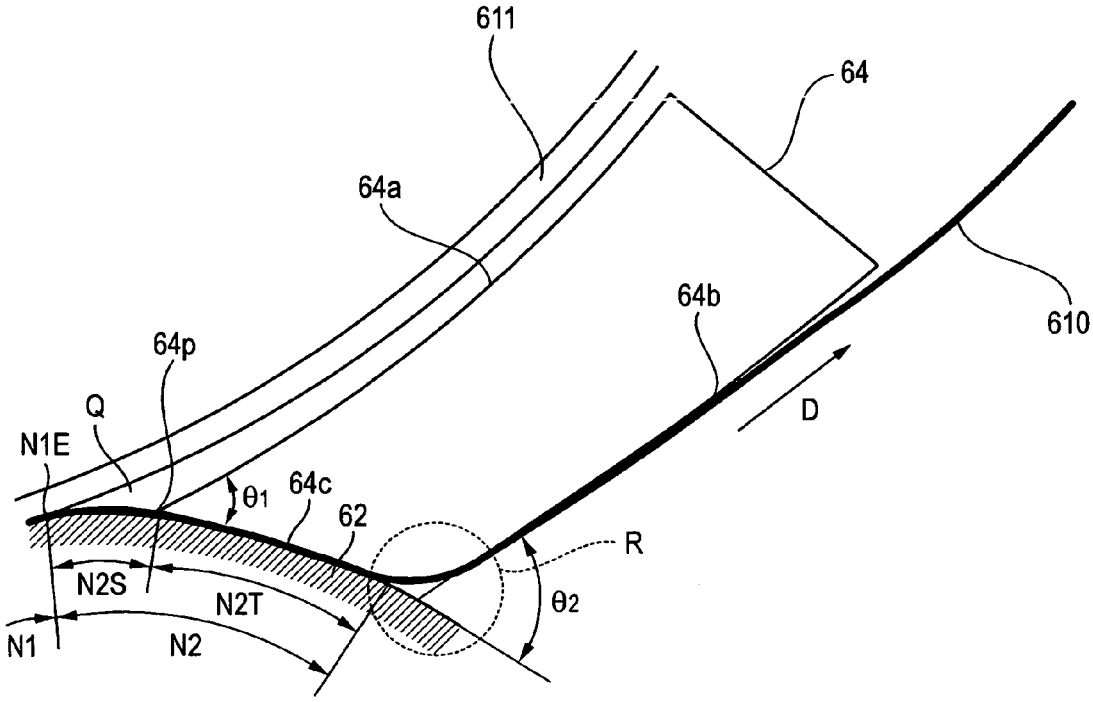
FIG. 6 is a schematic cross section showing the periphery of the area, in which the peeling pad is arranged.

FIG. 6 is a schematic cross section presenting the periphery of the area, in which the peeling pad 64 is arranged. As shown in FIG. 6, the peeling pad 64 is mainly provided with: an inner side face 64*a* confronting the fixing roll 611; an outer side face 64*b* for abruptly changing the advancing direction of the fixing belt 610 having passed through the peeling pad nip portion N2; and a pressure face 64*c* for pressing the fixing belt 610 onto the pressure roll 62.

The inner side face 64*a* of the peeling pad 64 is formed into such a curved face profiling the circumference of the fixing roll 611 as to arrange the peeling pad 64 as close (e.g., with the gap of 0.5 mm between the peeling pad 64 and the fixing roll 611) as possible to the fixing roll 611. In order to set the boundary area N2S as narrow as possible, as shown in FIG. 6, it is necessary that the peeling pad 64 is arranged to push the surface of the pressure roll 62 in the vicinity of the downstream side of the roll nip portion N1 (as also referred to FIG.

3) and in a wedge-shaped area Q which is defined by the fixing roll 611 and the pressure roll 62. For this necessity, the inner side face 64*a* is formed into such a curved face profiling the circumference of the fixing roll 611 that an upstream side end portion 64*p* of the inner side face 64*a* (i.e., the upstream side of the pressure face 64*c*) may be able to be arranged close to the downstream side end portion N1E of the roll nip portion N1, that is, the fixing roll 611 in the aforementioned wedge-shaped area Q. In the peeling pad 64 of this embodiment, the inner side face 64*a* is formed to have a general circumference having a radius of curvature of 33 mm. Here, the inner side face 64*a* should not be limited, if it is curved to profiling the circumference of the fixing roll 611, to the curved face such as the general circumference but can also be formed by bending plural flat faces stepwise.

The pressure face 64*c* of the peeling pad 64 presses the fixing belt 610 onto the pressure roll 62 and the surface thereof into contact with the surface of the pressure roll 62. For this pressing action, the pressure face 64*c* is formed into such a flat face that the fixing belt 610 may be homogeneously pressed onto the pressure roll 62. Moreover, the pressure face 64*c* may also be formed into a recessed curve profiling the circumference of the pressure roll 62 so that the pressing force can be better homogenized.

As described above, on the other hand, the upstream side end portion 64*p* is so arranged close to the fixing roll 611 as to make the width of the boundary area N2S as narrow as possible. At this time, the upstream side end portion 64*p* can also be arranged to abut against the fixing roll 611. With this setting, it is possible to narrow the width the boundary area N2S remarkably. Moreover, the pressure face 64*c* can establish a sufficient nip pressure in the boundary area N2S, because the upstream side end portion 64*p* can receive the pressing force from the fixing roll 611 at the same time.

Here, the pressure face 64*c* makes a sliding contact with the fixing belt 610. For smoothing the advancement of the fixing belt 610, therefore, the pressure face 64*c* is preferred to have its surface coated with a material such as Teflon (i.e., the trade name), which has a small friction coefficient and an excellent abrasion resistance.

Here is described the outer side face 64*b* of the peeling pad 64.

The outer side face 64*b* acts with the tension roll 615 and the fixing roll 611 to guide the fixing belt 610 and changes the advancing direction of the fixing belt 610 abruptly thereby to peel the paper sheet P off the fixing belt 610. In order to peel the paper sheet P stably off the fixing belt 610, therefore, an angle θ2 (as referred to FIG. 6) made between the tangent of the pressure roll 62 and the tangent of the outer side face 64*b* is set to 40 degrees or more in an upstream side end portion area (in which the fixing belt 610 is spaced from the pressure roll 62) of the outer side face 64*b*. In this abruptly curved upstream side end portion area R, moreover, the outer side face 64*b* is so curved as to move the fixing belt 610 smoothly in that area R.

Moreover, the outer side face 64*b* is formed into such a flat face inclined toward the tension roll 615 that the fixing belt 610 may smoothly advance, after peeled off from the pressure roll 62, toward the tension roll 615 and the fixing roll 611. In this case, the outer side face 64*b* can also be formed into a curved face toward the outer side (i.e., toward the fixing belt 610). For smoothing the advancement of the fixing belt 610, the outer side face 64*b* is preferred lice the pressure face 64*c* to have its surface coated with a material such as Teflon (i.e., the trade name), which has a small friction coefficient and an excellent abrasion resistance.

In the peeling pad 64 of this embodiment, moreover, the outer side face 64*b* is shaped so that the fixing belt 610 having passed through the peeling pad nip portion N2 may move while drawing different loci (or bent shapes) between the longitudinal middle portion and the two end portions of the peeling pad 64.

Figure 7A:
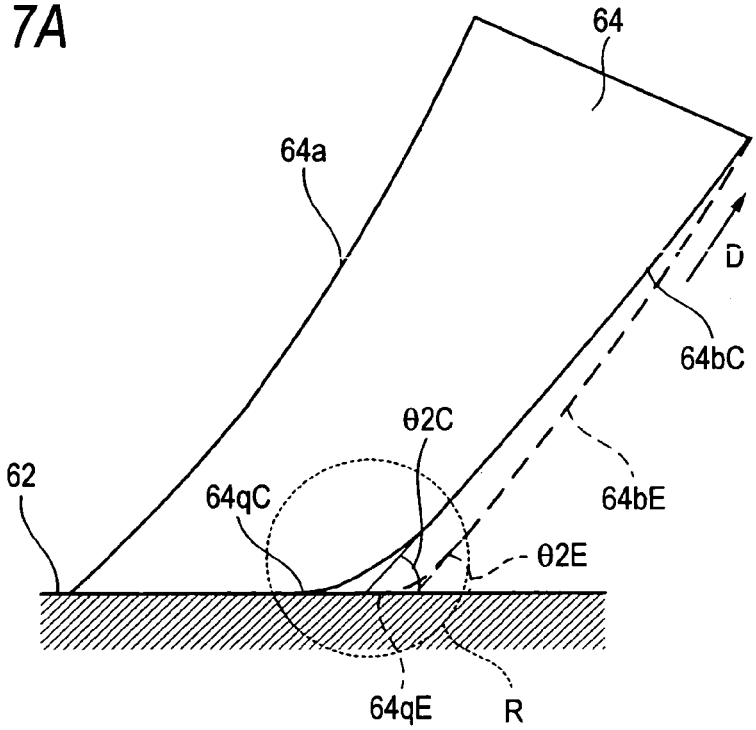
FIGS. 7A and 7B are diagrams for explaining the shape of the peeling pad.
Figure 7B:
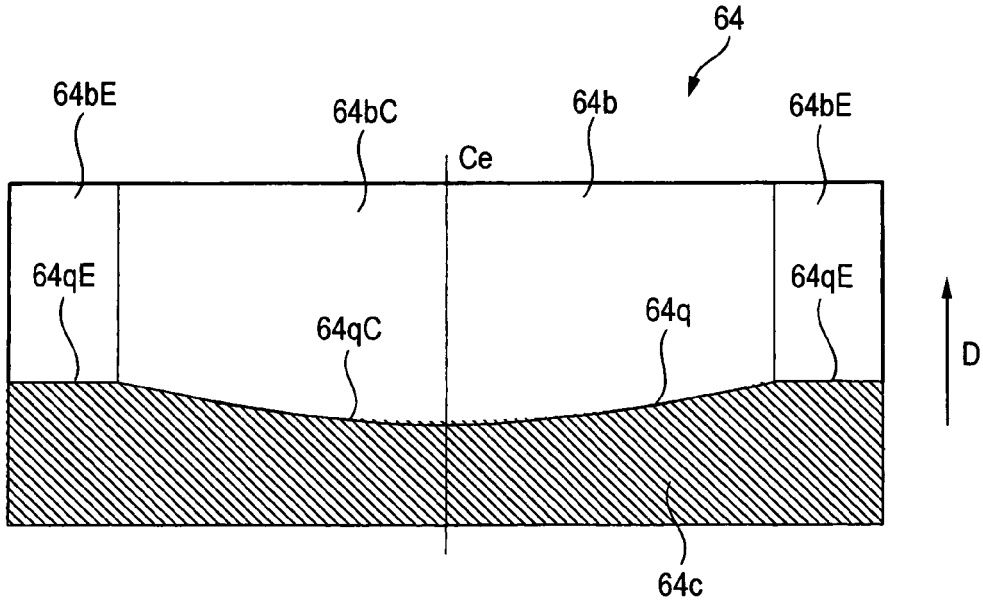

FIGS. 7A and 7B present diagrams for explaining the shape of the peeling pad 64, and FIG. 7A presents a cross sectional diagram of the peeling pad 64 whereas FIG. 7B presents a bottom view showing the peeling pad 64 from the side of the pressure face 64*c* (or from the pressure roll 62). In FIG. 7A, an outer side face 64*b*C of the longitudinal middle portion is indicated by a solid line, and the outer side faces 64*b*E of the two longitudinal end portions are indicated by a broken line. In FIG. 7B, on the other hand, the advancing direction of the fixing belt 610 is taken upward (by arrow D) from the bottom of the drawing.

As shown in FIGS. 7A and 7B, the peeling pad 64 of this embodiment is formed so that its edge (i.e., the middle portion leaving edge) 64*q*C, at which the outer side face 64*b*C of the longitudinal middle portion leaves the surface of the pressure roll 62, is positioned more upstream of the moving direction of the fixing belt 610 (or the moving direction of the pressure roll 62) than its edges (i.e., the end portion leaving edges) 64*q*E, at which the outer side faces 64*b*B of the two longitudinal end portions leave the surface of the pressure roll 62. With this configuration, the fixing belt 610 to move along the outer side face 64*b* leaves, just after having passed through the peeling pad nip portion N2, the surface of the pressure roll 62 the earliest at the longitudinal middle portion (i.e., the middle portion leaving edge 64*q*C). After this, the peeling pad 64 leaves the pressure roll 62 sequentially toward the two longitudinal end portions (or the end portion leaving edges 64*q*E). In accordance with that shift of the peeling position of the fixing belt 610, therefore, the paper sheet P sticking to the fixing belt 610 leaves the fixing belt 610 at first at the middle portion spacing edge 64*q*C and then sequentially toward the end portion leaving edges 64*q*E.

As described above, at the nip portion N, the toner images are melted by the heat of the fixing belt 610 so that the toner images become an adhesive to generate the sticking force between the paper sheet P and the fixing belt 610. In order to peel the paper sheet P at the peeling area R from the fixing belt 610, therefore, it is important to overcome the sticking force especially between the leading end portion of the paper sheet P and the fixing belt 610. Especially in the solid image such as a photographic image, however, the toner images are formed all over the surface from the leading end portion of the paper sheet P thereby to raise the sticking force between the paper sheet P and the fixing belt 610. This makes it generally difficult to separate the paper sheet P, in case the solid images are formed by using the thin sheet having the so-called "low nerve" as the paper sheet P.

In the fixing device 60 of this embodiment, therefore, the peeling pad 64 is formed so that the paper sheet P may be so sequentially in the area (i.e., the peeling area) R, in which the fixing belt 610 leaves the pressure roll 62, that it may be peeled sequentially off the longitudinal middle portion toward the two end portions. As a result, when the leading end portion of the paper sheet P is peeled off from the fixing belt 610, the "timely deviation" can be caused from the widthwise middle portion of the leading end portion of the paper sheet P to the two end portions. This "timely deviation" in this peel can disperse the sticking force timely between the paper sheet P and the fixing belt 610 at the leading end portion of the paper sheet P thereby to reduce the magnitude of the sticking force apparently.

Unlike the case, in which the leading end portion of the paper sheet P is simultaneously peeled wholly in the widthwise direction off the fixing belt 610, the paper sheet P may be peeled at first only at the portion of its leading end portion in the widthwise direction by the fixing device 60 of this embodiment so that the paper sheet P can be more reliably peeled off by the ordinary curvature separation. When the leading end portion of the paper sheet P is partially peeled off, the peeling position can be shifted toward the two end portions as the paper sheet P moves, while concentrating the peeling force sequentially on the boundary between the peeled portion and the unpeeled portion. As a result, the subsequent peel can also be easily performed by the ordinary curvature separation. If the peeling pad 64 of this embodiment is thus used, the sticking force between the paper sheet P and the fixing belt 610 can be timely dispersed to perform the peel smoothly and stably by the ordinary curvature separation. As a result, the peeling performance at the peeling area R can be improved to realize the paper separation stably for the thin sheet of the low "nerve" having the solid image.

Here is specifically described the shape of the outer side face 64*b*. In the peeling pad 64 of this embodiment, it is necessary that the fixing belt 610 leaves the earliest at its central portion leaving edge 64*q*C and then sequentially toward the end portion leaving edges 64*q*E. As shown in FIG. 7B), therefore, a ridge (or edge) or the boundary between the outer side face 64*b* of the peeling pad 64 and the pressure face 64*c* is formed of such a curved profile at the central portion leaving edge 64*q*C from the longitudinal middle position Ce to the two side end portion leaving edges 64*q*E as is curved downstream from the upstream side of the fixing belt 610 in the moving direction. In addition to this curved profile, the middle portion leaving edge 64*q*C can also be formed by a stepped profile from the upstream side to the downstream side in the moving direction of the fixing belt 610.

On the other hand, the end portion leaving edges 64*q*E are preferably formed in such a straight profile that no concentrated pressure may be applied to the stretched fixing belt 610.

As shown in FIG. 7A, moreover, the angle θ2 made between the tangent of the outer side face 64*b* and the tangent of the pressure roll 62 is set so that the angle θ2C made by the outer side face 64*b* of the longitudinal middle portion is exemplified by 44 degrees at the longitudinal middle position Ce and so that the angle θ2E made by the outer side faces 64*b*E of the two longitudinal end portions is exemplified by 50 degrees. In the outer side face 64*b* of the longitudinal middle portion, moreover, the angle θ2C is made to increase continuously to the angle θ2E toward the outer side faces 64*b*E of the two longitudinal end portions.

The reason why the angles of inclination of the outer side face 64*b* in the longitudinal direction of the peeling pad 64 are made is described in the following. Specifically, the central portion leaving edge 64*q*C is formed more upstream than the end portion leaving edges 64*q*E in the moving direction of the fixing belt 610 so that the fixing belt 610 having passed through the nip portion N moves in a roundabout manner at the two end portions than the central portion toward the outer periphery. As a result, the tension of the fixing belt 610 becomes higher toward the two end portions. This is because the rise in the tension on the end portion sides of the fixing belt 610 is suppressed as much as possible by setting the inclination angle of the outer side face 64*b* steeper at the two end portions.

Thus, in the fixing device 60 of this embodiment, the nip portion N composed of the roll nip portion N1 and the peeling pad nip portion N2 is formed in the area where the fixing belt module 61 and the pressure roll 62 are pressed to contact with each other. Moreover, the peeling pad 64 for forming the peeling pad nip portion N2 is arranged close to the downstream side of the roll nip portion N1, and the peeling pad 64 is set to press the pressure roll 62. In the nip portion N, therefore, the formation of the area of the valley, in which the nip pressure drops, is suppressed. In the boundary area N2S, too, it is possible to build up the nip pressure Pn satisfying the aforementioned Equation (1). As a result, moreover, it is possible to set the nip pressure continuously and uniformly in the area of the roll nip portion N1 in the nip portion N from the position of the peak nip pressure to the most downstream position of the peeling pad nip portion N2.

By setting the predetermined nip pressure Pn in the boundary area N2S, therefore, it is possible to suppress the generation of the air bubbles in the boundary area N2S. By setting the nip pressure to become continuously and uniformly lower, the water vapor, which is suppressed by the high nip pressure in the roll nip portion N1, or the air to be thermally expanded can be gradually released in the passage till it passes through the peeling pad nip portion N2. As a result, it is possible to suppress the phenomenon, in which the water vapor or the thermally expanded air migrates as air bubbles in the nip. Therefore, the toner images, which are not completely solidified yet, can be hardly disturbed to suppress the image defects such as the irregularities in the fixed image.

Moreover, the peeling pad 64 forming the peeling pad nip portion N2 is formed to have a substantially arcuate cross section so that the fixing belt 610 having passed through the peeling pad nip portion N2 is so abruptly changed to turn in its advancing direction. As a result, the paper sheet P having passed through the roll nip portion N1 and the peeling pad nip portion N2 is peeled, at the instant when it leaves the peeling pad nip portion N2, off the fixing belt 610 so that it can be subjected to the curvature separation.

In addition, the peeling pad 64 is configured to peel the paper sheet P sequentially from the longitudinal middle portion toward the two end portions. As a result, the "timely deviation" can be caused in the peel of the leading end portion of the paper sheet P from the fixing belt 610 thereby to disperse the sticking force timely between the paper sheet P at the leading end portion and the fixing belt 610. As a result, the peeling performance at the peeling area R can be improved to realize the paper separation stably for the thin sheet of the low "nerve" having the solid image.

Evaluations are made on the paper separating performance of the fixing device 60 of this embodiment. In this evaluation test, the fixing device 60 had its process speed set to 440 mm/s and was fed with 50 sheets. The paper sheets P used were OK medium-quality coated paper (of 59.6 gsm) and OK top coated S paper (85 gsm) of Oji Paper Manufacturing (Ltd.). Moreover, the toner image to be formed on the paper sheet P was a sold image having a leading end margin width of 3 mm and a toner density of 13 g/m$^2$. These evaluation conditions of using the thin paper sheet P of low weighting and forming the solid image of the small leading end margin were adopted because they were strict for the paper sheet separation.

For comparisons, the fixing device of the related art not having the peeling pad 64 but having the nip portion N composed of the roll nip portion N1 was used and subjected to similar evaluation tests.

The evaluation results are presented in FIG. 8. The fixing device 60 of this embodiment succeeded in the peels of all fifty sheets fed but had no jamming, as shown in FIG. 8. On the contrary, the fixing device of the related art had twenty five separation failures for fifty sheets of OK medium-quality coated paper. Moreover, ten separation failures occurred for fifty sheets of OK top coated S paper. Thus, it has been confirmed that the fixing device 60 of this embodiment was superior in the paper separating performance.

Here is described the fixing actions in the fixing device 60 of this embodiment.

Figure 2:
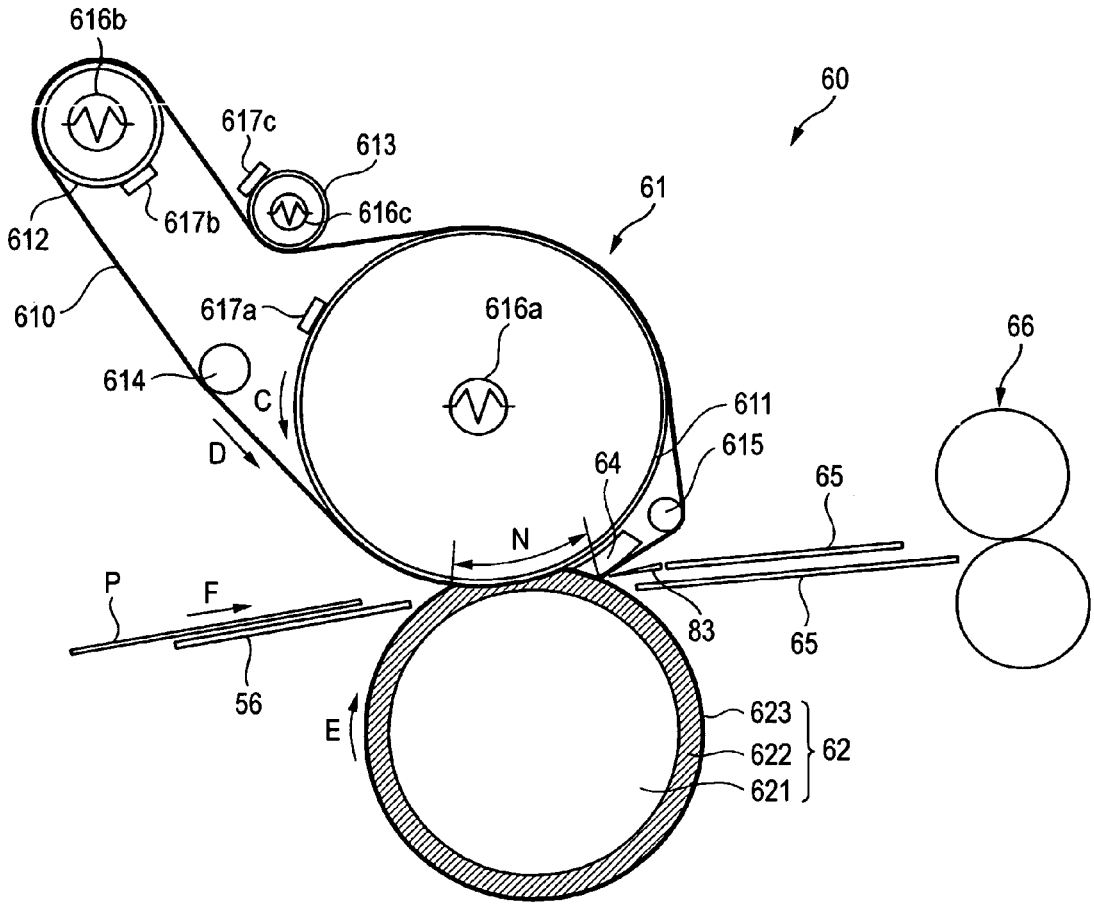
FIG. 2 is a side cross section showing a schematic configuration of a fixing device according to a first exemplary embodiment.

The paper sheet P, to which the unfixed toner image has been electrostatically transferred at the secondary transfer unit 20 (as referred to FIG. 1) of the image forming apparatus, is conveyed toward the nip portion N of the fixing device 60 (in the direction of arrow F, as referred to FIG. 2) by the conveyor belt 55 and the fixing entry guide 56. Moreover, the unfixed toner image on the surface of the paper sheet P to pass through the nip portion N is fixed on the paper sheet P mainly by the pressure and heat to act mainly on the roll nip portion N1.

At this time, in the fixing device 60 of this embodiment, the heat to act on the nip portion N is fed mainly by the fixing belt 610. The fixing belt 610 is heated by the heat fed through the fixing roll 611 from the halogen heater 616*a* arranged in the fixing roll 611, by the heat fed through the tension roll 613 from the halogen heater 616*b* arranged in the tension roll 612, and by the heat fed through the tension roll 613 from the halogen heater 616*c* arranged in the tension roll 613. As a result, even in case the thermal energy is insufficient with only the fixing roll 611, the thermal energy can be supplied properly and promptly from the tension roll 612 and the tension roll 613. Therefore, the nip portion N can retain a sufficient calorie even when the process speed is as high as 440 mm/s.

In the fixing device 60 of this embodiment, the fixing belt 610 to function as the direct heating member can be formed to have an extremely low heat capacity. In addition, the fixing belt 610 is configured to contact over a wide wrapping area (or a large wrapping angle) with the tension roll 612 and the tension roll 613. As a result, for the short period of one turn of the fixing belt 610, a sufficient calorie is fed from the fixing roll 611, the tension roll 612 and the tension roll 613 so that the fixing belt 610 can be returned for a short time to the necessary fixing temperature. As a result, the nip portion N can be always kept at the predetermined fixing temperature even if the fixing device 60 is speeded up.

As a result, the fixing temperature can be kept substantially constant in the fixing device 60 of this embodiment even at the continuous paper feeding time. Moreover, the occurrence of the temperature drooping phenomenon, in which the fixing temperature drops at the starting time of the high-speed fixing operations, can be suppressed. Especially in the fixing operations of a cardboard of a high heat capacity, too, it is possible to keep the fixing temperature and suppress the temperature droop. Even in case it is necessary to switch (to raise and drop the fixing temperature) the fixing temperature midway according to the paper kind, the switching to the desired temperature can be performed easily and quickly by adjusting the outputs of the halogen heater 616*a*, the halogen heater 616*b* and the halogen heater 616*c*, because the heat capacity of the fixing belt 610 is low.

In the fixing device 60 of this embodiment, on the other hand, the fixing roll 611 is a hard roll made of aluminum, and the pressure roll 62 is a soft roll coated with the elastic layer 622. In the roll nip portion N1, therefore, the fixing roll 611 is hardly warped, but the pressure roll 62 is warped at its surface to form the nip area having the width in the advancing direction of the fixing belt 610. Thus in the roll nip portion N1, the fixing roll 611 on the side where the fixing belt 610 is wrapped is hardly deformed. Therefore, the fixing belt 610 can pass through the roll nip portion N1 while keeping its advancing speed constant. As a result, the fixing belt 610 can be prevented from being wrinkled or distorted at the roll nip portion N1 so that a fixed image of a high quality can be stably provided.

After having passed through the roll nip portion N1, the paper sheet P is conveyed to the peeling pad nip portion N2. This peeling pad nip portion N2 is so formed that the peeling pad 64 is pressed onto the pressure roll 62 to press the fixing belt 610 into contact with the pressure roll 62. As shown in FIG. 3, therefore, the roll nip portion N1 is made convex downward by the curvature of the fixing roll 611, but the peeling pad nip portion N2 is made convex upward by the curvature of the pressure roll 62.

As a result, the paper sheet P having been heated and pressed in the roll nip portion N1 by the curvature of the fixing roll 611 is changed in its advancing direction at the peeling pad nip portion N2 by the curvatures which are directed in the opposite directions by the pressure roll 62. At this direction change, a small micro slip is caused between the toner image on the paper sheet P and the surface of the fixing belt 610. As a result, the sticking force between the toner image and the fixing belt 610 is weakened to establish the state, in which the paper sheet P is easily peeled off from the fixing belt 610. Thus, the peeling pad nip portion N2 is positioned at the preparation step for ensuring the peel at the final peeling step.

At the exit of the peeling pad nip portion N2, moreover, the fixing belt 610 is conveyed to be wrapped on the peeling pad 64 so that its conveying direction is abruptly changed. In other words, the fixing belt 610 moves along the outer side face 64*b* of the peeling pad 64 so that it is largely bent. As a result, the paper sheet P having its sticking force weakened to the fixing belt 610 in the peeling pad nip portion N2 self-strips from the fixing belt 610 by the paper nerve owned by the paper sheet P itself.

At this time, the peeling pad 64 is configured to peel the paper sheet P from the longitudinal middle portion to the two end portions, as has been described hereinbefore. As a result, the "timely deviation" can be established in the peel of the leading end portion of the paper sheet P from the fixing belt 610, so that the sticking force at the leading end portion of the paper sheet P between the paper sheet P and the fixing belt 610 can be timely dispersed. As a result, the peeling performance at the peeling area R can be improved so that the paper sheet P is stably subjected to the curvature separation from the fixing belt 610 at the instant when it leaves the peeling pad nip portion N2.

The paper sheet P separated from the fixing belt 610 is guided in its advancing direction by a peel guide plate 83, which is arranged as one example of the peel guide member arranged on the downstream side of the peeling pad nip portion N2. In order to scoop the widthwise middle portion of the paper sheet P peeled at first off the fixing belt 610 by the peeling pad 64, the peel guide plate 83 is formed so that its edge face 83*a* on the side of the peeling pad nip portion N2 is curved convex at its longitudinal middle portion on the side of the peeling pad nip portion N2. By thus combining the peeling pad 64 and the peel guide plate 83, the peeling performance can be further enhanced to the thin coated paper having no nerve, especially the coated paper having absorbed the moisture under a highly humid environment.

The paper sheet P guided by the peel guide plate 83 is then discharged to the outside of the device by an eject guide 65 and an eject roll 66 (as referred to FIG. 2), so that the fixing process is completed.

As has been described hereinbefore, the fixing device 60 of this embodiment uses the fixing belt module 61, which is configured by stretching the fixing belt 610 as the heating member by the plural rolls including the fixing roll 611. Even if the image forming apparatus is speeded up, therefore, the predetermined fixing temperature can always be kept at the fixing device 60. It is also possible to suppress the occurrence of the temperature drooping phenomenon, in which the fixing temperature drops at the time of starting the high-speed fixing actions. It is, therefore, possible to provide many fixed images of a high quality for a short time period.

At the same time, the nip portion N is composed of the roll nip portion N1, and the peeling pad nip portion N2 disposed downstream of the roll nip portion N1 and formed to continue from the roll nip portion N1. Moreover, the peeling pad 64 forming the peeling pad nip portion N2 is so arranged close to the downstream side of the roll nip portion N1 as to press the pressure roll 62. As a result, the nip pressure Pn satisfying the aforementioned Equation (1) is set at the boundary area N25 so that the valley area for the nip pressure to drop can be prevented from occurring thereby to suppress the air bubbles in the boundary area N2S. Moreover, the nip pressure can be set to decrease continuously and uniformly in the area in the roll nip portion N1 from the position of the peak nip pressure to the most downstream position of the peeling pad nip portion N2.

Thus in the fixing device 60 of this embodiment, by suppressing the generation of the air bubbles in the boundary area N2S and by setting the nip pressure to become continuously and uniformly lower, the water vapor, which is suppressed by the high nip pressure in the roll nip portion N1, or the air to be thermally expanded can be gradually released in the passage till it passes through the peeling pad nip portion N2 thereby to make it possible to suppress the phenomenon, in which the water vapor or the thermally expanded air migrates as air bubbles in the nip. Therefore, the toner images, which are not completely solidified yet, can be hardly disturbed to suppress the image defects such as the irregularities in the fixed image.

Moreover, the peeling pad 64 forming the peeling pad nip portion N2 is formed to have a substantially arcuate cross section so that the fixing belt 610 having passed through the peeling pad nip portion N2 is so abruptly changed to turn in its advancing direction. As a result, the paper sheet P having passed through the roll nip portion N1 and the peeling pad nip portion N2 is peeled, at the instant when it leaves the peeling pad nip portion N2, off the fixing belt 610 so that it can be subjected to the curvature separation.

In addition, the peeling pad 64 is configured to peel the paper sheet P sequentially from the longitudinal middle portion toward the two end portions. As a result, the "timely deviation" can be caused in the peel of the leading end portion of the paper sheet P from the fixing belt 610 thereby to disperse the sticking force timely between the paper sheet P at the leading end portion and the fixing belt 610. As a result, the peeling performance at the peeling area R can be improved to realize the paper separation stably for the thin sheet of the low "nerve" having the solid image.

Second Embodiment

The first exemplary embodiment has been described on the configuration, in which the paper sheet P is sequentially peeled off, from the widthwise middle portion to the two end portions, by forming the outer side face 64*b* of the peeling pad 64 so that the central portion spacing edge 64*q*C may be positioned more upstream in the moving direction of the fixing belt 610 than the end portion leaving edges 64*q*E. A second exemplary embodiment is described on the configuration, in which the paper sheet P is sequentially peeled by making the inclination angle θ2C of the outer side face 26*b*C of the longitudinal middle portion more than the inclination angle θ2E of the outer side faces 64*b*E of the two end portions. Here, structures similar to those of the first embodiment are designated by similar reference numerals, and their detailed descriptions are omitted.

Figure 9A:
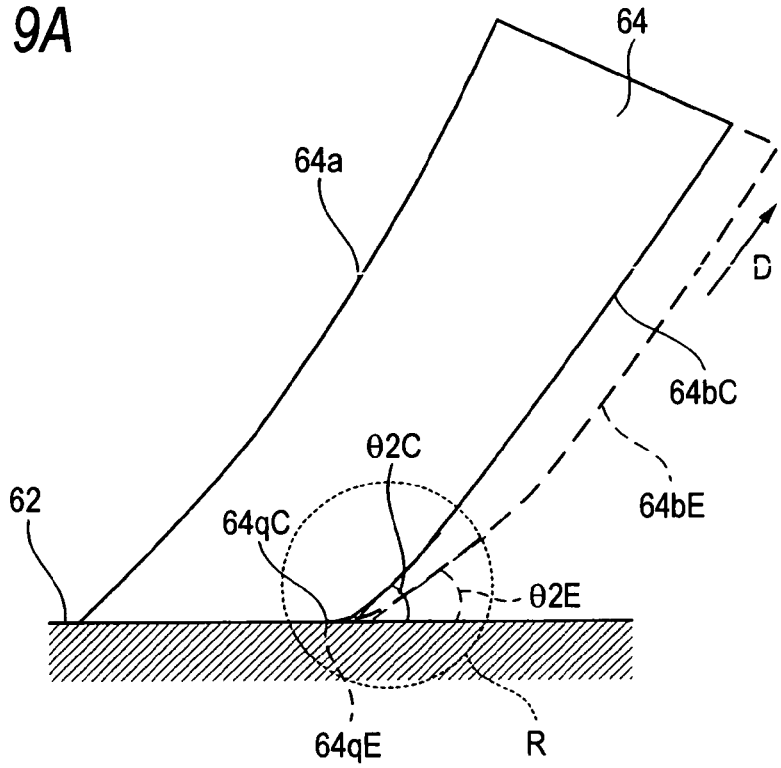
FIGS. 9A and 9B are diagrams for explaining the shape of a peeling pad.
Figure 9B:
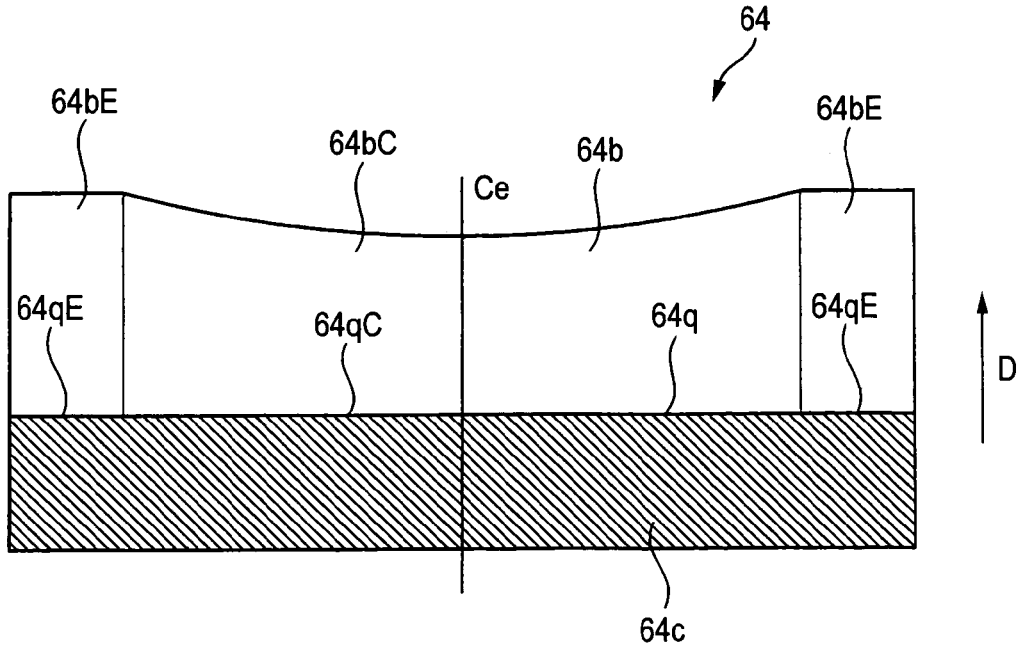

FIGS. 9A and 9B presents diagrams for explaining the shape of the peeling pad 64, and FIG. 9A presents a cross sectional diagram of the peeling pad 64 whereas FIG. 9B presents a bottom view showing the peeling pad 64 from the side of the pressure face 64*c* (or from the pressure roll 62). In FIG. 9A, an outer side face 64*b*C of the longitudinal middle portion is indicated by a solid line, and the outer side faces 64*b*E of the two longitudinal end portions are indicated by a broken line. In FIG. 9B, on the other hand, the advancing direction of the fixing belt 610 is taken upward (by arrow D) from the bottom of the Drawing.

In the peeling pad 64 of this embodiment, as shown in FIGS. 9A and 9B, in the area (i.e., the peeling area) for the fixing belt 610 to leave the pressure roll 62, the inclination angle θ2C of the outer side face 64*b* of the longitudinal middle portion is made larger than the inclination angle θ2E of the outer side faces 64*b*E of the two end portions. In short, θ2C>θ2E.

On the other hand, the edge (i.e., the central portion leaving edge) 64*q*C, at which the outer side face 64*b*C of the longitudinal middle portion leaves the surface of the pressure roll 62), and the edges (i.e., the end portion leaving edges) 64*q*E, at which the outer side faces 64*b*E of the two longitudinal end portions leave the surface of the pressure roll 62, are set at the same positions in the moving direction of the fixing belt 610.

With this configuration, the fixing belt 610 moving along the outer side face 64*b* leaves, just after it passed through the peeling pad nip portion N2, the pressure roll 62 simultaneously at the longitudinal middle portion (i.e., the middle portion leaving edge 64*q*C) and the two longitudinal end portions (i.e., the end portion leaving edges 64*q*E). However, the inclination angle θ2C of the outer side face 64*b*C of the longitudinal middle portion is made larger than the inclination angle θ2E of the outer side faces 64*b*E of the two end portions so that the paper sheet P is separated at first from the outer side face 64*b*C of the longitudinal middle portion of the larger inclination angle θ2C. Then, the paper sheet P is sequentially peeled toward the outer side faces 64*b*E of the two end portions having the smaller inclination angle θ2E.

By making the inclination angle θ2 of the outer side face 64*b* different as in the peeling pad 64 of this embodiment, the fixing belt 610 having passed through the peeling pad nip portion N2 can be set to move while drawing different loci (or bent shapes) at the middle portion and the two end portions of the peeling pad 64 in the longitudinal direction. Like the case of the first embodiment using the peeling pad 64, therefore, the "timely deviation" can be caused in the peel of the leading end portion of the paper sheet P from the fixing belt 610. This "timely deviation" in this peel can disperse the sticking force timely between the paper sheet P and the fixing belt 610 at the leading end portion of the paper sheet P. As a result, the peeling performance at the peeling area R can be improved to subject the paper sheet P stably to the curvature separation from the fixing belt 610 at the instant when it leaves the peeling pad nip portion N2.

Here in the peeling pad 64 of this embodiment, the peeling area R is formed so that the inclination angle θ2C of the outer side face 64*b*C of the longitudinal middle portion is larger than the inclination angle θ2E of the outer side faces 64*b*E of the two end portions. As can be easily understood from FIGS. 9A and 9B, therefore, the fixing belt 610 to pass through the outer side faces 64*b*E of the two end portions makes a roundabout farther to the outer periphery than the central portion.

As a result, the tension of the fixing belt 610 becomes so higher at the two end portions that the difference from that of the central portion cannot be ignored. When the tension of the fixing belt 610 thus becomes more heterogeneous in the widthwise direction than a predetermined value, the fixing belt 610 may be easily distorted or wrinkled to affect the image quality adversely.

Figure 10:
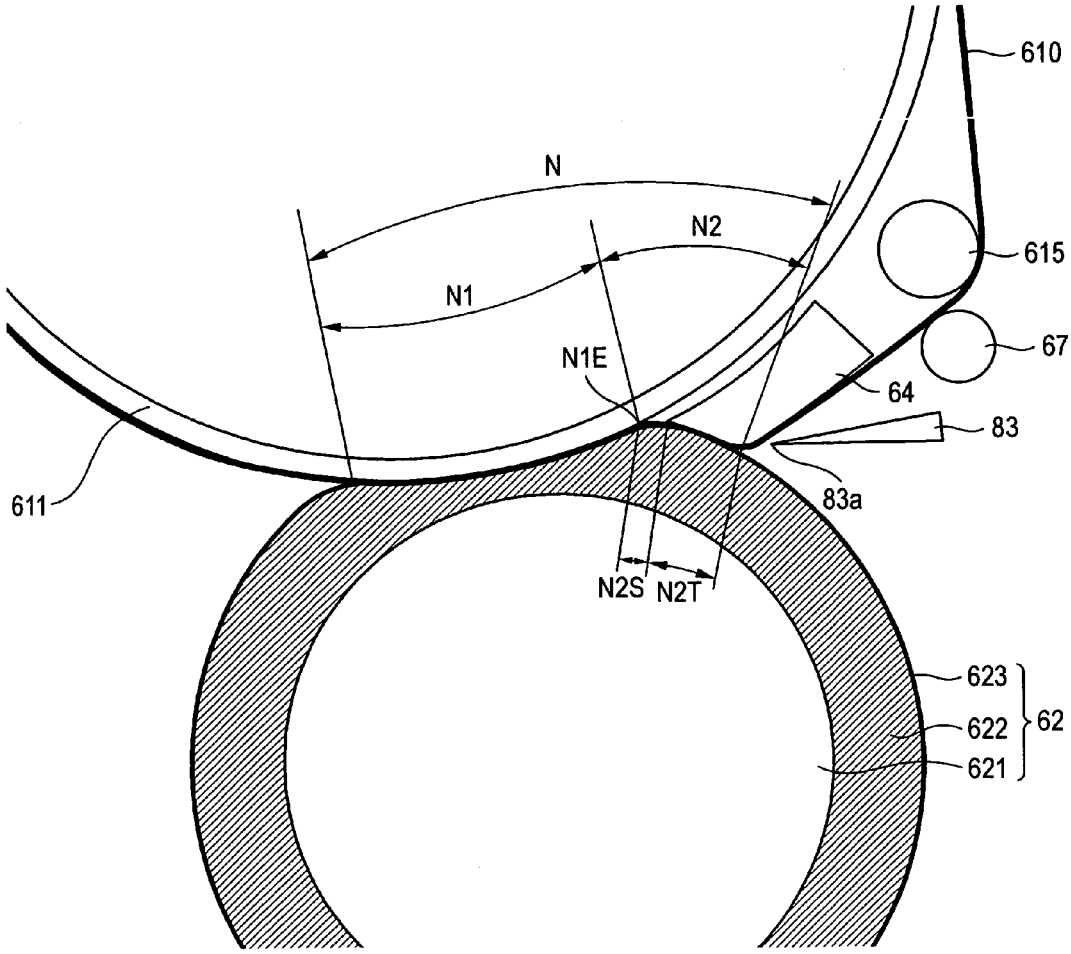
FIG. 10 is a schematic cross section showing the area close to a nip portion.

In this embodiment, therefore, a peripheral length adjusting roll 67 is arranged as one example of the peripheral length adjusting member on the downstream side of the peeling pad 64 in the advancing direction of the fixing belt 610, as shown in FIG. 10 (i.e., a schematic cross section showing the area close to the nip portion N). This peripheral length adjusting roll 67 is formed so that the external diameter of the axial area corresponding to the outer side face 64*b*C of the longitudinal middle portion of the peeling pad 64 is made smaller than the external diameter of the axial areas corresponding to the outer side faces 64*b*E of the two longitudinal end portions. Moreover, the peripheral length adjusting roll 67 is arranged and pressed to contact with the fixing belt 610 from the outer side.

By thus arranging the peripheral length adjusting roll 67, the route length difference to be made in the widthwise direction of the fixing belt 610 at the time of passing through the peeling pad 64 is compensated by the external diameter difference of the peripheral length adjusting roll 67 thereby to homogenize the tension of the fixing belt 610 in the widthwise direction. As a result, the fixing belt 610 can be prevented from being distorted or wrinkled thereby to suppress the adverse affect on the image quality.

Third Embodiment

The first embodiment has been described on the configuration, in which the pressure roll 62 is used as the pressure member arranged and pressed to contact with the fixing belt module 61 in the fixing device 60 to be mounted in the image forming apparatus. A third exemplary embodiment is described on the configuration using a pressure belt module 70, in which a pressure belt 700 is stretched by plural rolls acting as the pressure member. Here, structures similar to those of the first embodiment are designated by similar reference numerals, and their detailed descriptions are omitted.

Figure 11:
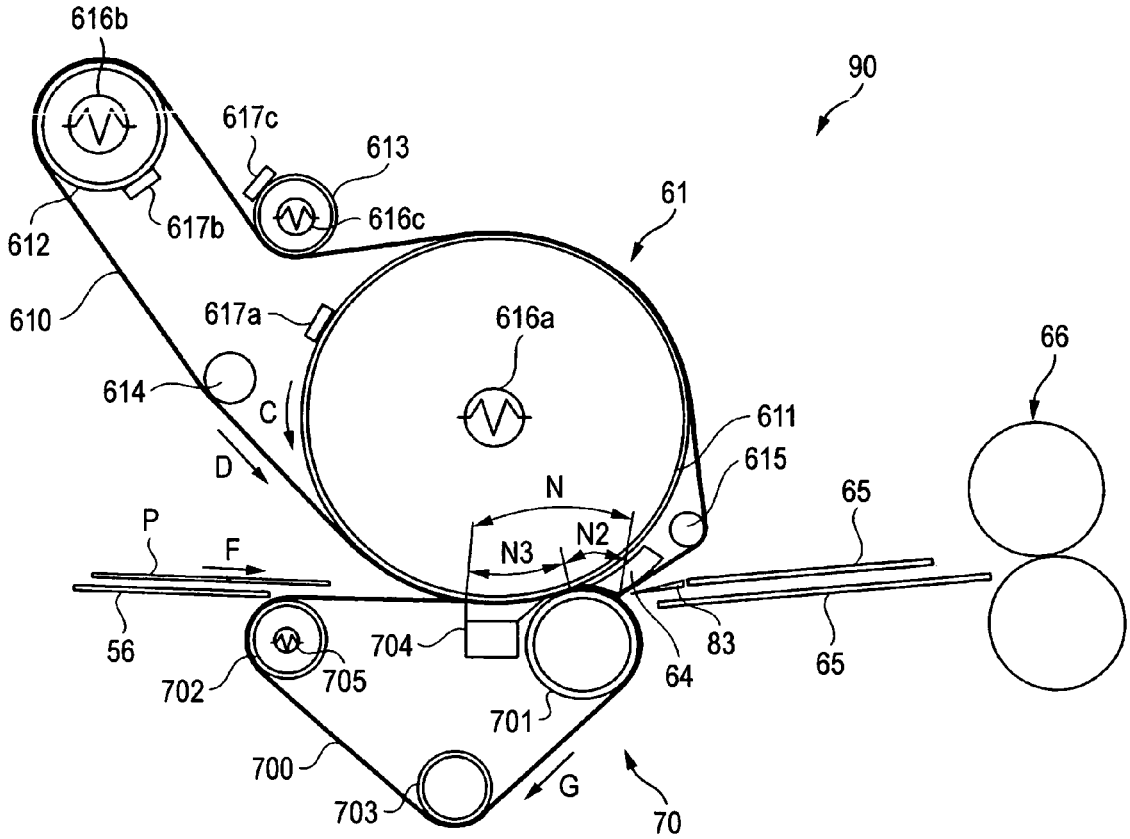
FIG. 11 is a side cross section showing a schematic configuration of a fixing device according to a third exemplary embodiment.

FIG. 11 is a side cross section showing the configuration of a fixing device 90 according to this embodiment. The structure of the fixing device 90 of this embodiment is similar to that of the fixing device 60 of the first embodiment, excepting that the pressure belt module 70 is arranged as the pressure member in place of the pressure roll 62.

The pressure belt module 70 of this embodiment has a major portion composed of: the pressure belt 700 which is looped over three rolls of a pressure roll 701, an inlet roll 702 and a tension roll 703 under tension; and a pressure pad 704 acting as the pressure member arranged to be urged onto the fixing roll 611 through the pressure belt 700 and the fixing belt 610. Moreover, the pressure belt module 70 is so arranged as is pressed onto the fixing belt module 61. As the fixing roll 611 of the fixing belt module 61 rotates in the direction of arrow C, the pressure belt 700 follows the fixing roll 611 to turn in the direction of arrow G, and its advancing speed is 440 mm/s, which is equal to the surface speed of the fixing roll 611.

In the nip portion N where the pressure belt module 70 and the fixing belt module 61 are pressed to contact, a belt nip portion N3, in which the pressure belt 700 is pressed to contact with the outer periphery of the fixing belt 610, is set in the wrap area where the fixing belt 610 is wrapped on the fixing roll 611.

In the fixing device 90 of this embodiment, the pressure pad 704 is so arranged on the inner side of the pressure belt 700 as is biased toward the side of the fixing roll 611 through the pressure belt 700, thereby to press the pressure belt 700 into the wrap area of the fixing roll 611. In the most upstream portion of the belt nip portion N3, moreover, the pressure roll 701 is biased toward the center axis of the fixing roll 611 through the pressure belt 700 and the fixing belt 610 by the (not-shown) compression coil spring acting as pressure section, thereby to establish a locally high pressure at the abutting portion between the fixing roll 611 and the fixing belt 610.

As a result, the belt nip portion N3 can be widely formed to realize a more stable fixing performance for the toner images on the paper sheet P. Moreover, an efficient pressure can be applied to the molten toner images by the locally high pressure of the pressure roll 701, to hold a high fixing property and to smoothen the toner image surface thereby to give an excellent luster to the color image.

Here, the pressure belt 700 arranged in the pressure belt module 70 is formed of a base layer made of a highly refractory resin such as polyimide, polyamide or poly-amide-imide. The base layer is formed to have a thickness of about 50 to 125 μm. Moreover, the pressure belt 700 may also be configured to have the base layer coated on its surface on the side of the fixing roll 611 or on its both surfaces with a peeling layer. The peeling layer of this case is preferably a coating of a fluorine resin such as PFA having a thickness of 5 to 20 μm. If necessary, moreover, a laminated structure may also be adopted to have an elastic layer formed between the base layer and the peeling layer. In this case, the elastic layer can be made of silicone rubber having a thickness of 100 to 200 μm. In the fixing device 90 of this embodiment, the pressure belt 700 is formed of only the base layer of a polyimide film having a thickness of 75 μm, a width of 350 μm and a peripheral length of 240 mm.

On the other hand, the three rolls stretching the pressure belt 700 are composed of: the pressure roll 701 having a steel core coated with silicon rubber as the elastic layer; the inlet roll 702 made of stainless steel; and the tension roll 703 made of stainless steel, and stretch the pressure belt 700 with a tension of 10 Kgf. The individual external diameters are: 25 mm for the pressure roll 701; 22 mm for the inlet roll 702; and 20 mm for the tension roll 703, and the length is 360 mm. Inside of the inlet roll 702, on the other hand, a halogen heater 705 is arranged as the heat source. Moreover, the pressure belt 700 is preheated and controlled to the surface temperature of 120° C. by the not-shown temperature sensor and the control unit 40 (as referred to FIG. 1).

The pressure roll 701 is biased toward the center axis of the fixing roll 611 through the pressure belt 700 and the fixing belt 610 by the (not-shown) compression coil spring acting as the pressure section, thereby to establish the locally high pressure at the abutting portion between the fixing roll 611 and the fixing belt 610. In this case, the pressure roll 701 is made so diametrically smaller than the fixing roll 611 as to apply the locally high pressure efficiently under a low load to the fixing roll 611 and the fixing belt 610.

Here, any of the pressure roll 701, the inlet roll 702 and the tension roll 703 can be provided with a belt edge position detecting mechanism for detecting the belt edge positions of the pressure belt 700, and an axial displacement mechanism for displaying the abutting position of the pressure belt 700 in the axial direction in accordance with the detection result of the belt edge position detecting mechanism thereby to control the meandering (or the belt walk) of the pressure belt 700.

The pressure pad 704 acting as the pressure member is composed of an elastic member for retaining a wide belt nip portion N3, and a low-friction layer formed on the face for the elastic member to contact with the inner periphery of the elastic member, and is held on the (not-shown) holder made of a metal or the like. The elastic member having the low-friction layer on the surface is formed on the side of the fixing roll 611 into a recessed shape substantially profiling the outer circumference of the fixing roll 611, and is arranged and pressed onto the fixing roll 611 thereby to form the entry side area of the belt nip portion N3 formed in the wrap area of the fixing roll 611.

The elastic member for the pressure pad 704 can be exemplified by a highly refractory elastic member such as silicone rubber or fluorine rubber or by a leaf spring. The low-friction layer formed on the elastic member is formed to reduce the sliding resistance between the inner periphery of the pressure belt 700 and the pressure pad 704, and is desirably made of an abrasion resisting material having a low friction coefficient. The low-friction layer can be specified by a glass fiber sheet impregnated with Teflon (i.e., the trade name), a fluorine resin sheet or a fluorine resin coating.

In the fixing device 90 of this embodiment, too, the peeling pad 64 is also arranged close to the downstream side of the belt nip portion N3. Moreover, the peeling pad 64 is arranged to press the fixing belt 610 onto the surface of the pressure roll 701. As a result, the belt nip portion N3 is continued by the peeling pad nip portion N2, in which the fixing belt 610 is wrapped on the side of the pressure roll 701.

In the peeling pad nip portion N2 set by the peeling pad 64, like the fixing device 60 of the first embodiment, the nip pressure Pn satisfying the aforementioned Equation (1), as described in connection with the first embodiment, is set in the boundary area N2S, so that the valley area having the nip pressure dropped can be prevented to suppress the generation of the air bubbles in the boundary area N2S. Moreover, the nip pressure can be set to become continuously and uniformly lower in the area in the roll nip portion N1 from the position of the peak nip pressure to the most downstream position of the peeling pad nip portion N2.

Thus in the fixing device 90 of this embodiment, by suppressing the generation of the air bubbles in the boundary area N2S and by setting the nip pressure to become continuously and uniformly lower, the water vapor, which is suppressed by the high nip pressure in the belt nip portion N3, or the air to be thermally expanded can be gradually released in the passage till it passes through the peeling pad nip portion N2 thereby to make it possible to suppress the phenomenon, in which the water vapor or the thermally expanded air migrates as air bubbles in the nip. Therefore, the toner images, which are not completely solidified yet, can be hardly disturbed to suppress the image defects such as the irregularities in the fixed image.

Moreover, the peeling pad 64 forming the peeling pad nip portion N2 is formed to have a substantially arcuate cross section. Therefore, the fixing belt 610 having passed through the peeling belt nip portion N3 is so abruptly changed to turn in its advancing direction. As a result, the paper sheet P having passed through the roll nip portion N1 and the peeling pad nip portion N2 is peeled, at the instant when it leaves the peeling pad nip portion N2, off the fixing belt 610 so that it can be stably subjected to the curvature separation.

In addition, the peeling pad 64 is configured to peel the paper sheet P sequentially from the longitudinal middle portion toward the two end portions. As a result, the "timely deviation" can be caused in the peel of the leading end portion of the paper sheet P from the fixing belt 610 thereby to disperse the sticking force timely between the paper sheet P at the leading end portion and the fixing belt 610. As a result, the peeling performance at the peeling area R can be improved to realize the paper separation stably for the thin sheet of the low "nerve" having the solid image.

Fourth Embodiment

The first embodiment has been described on such a configuration of the fixing device 60 to be mounted in the image forming apparatus, that the pressure roll 62 is arranged and pressed as the pressure member onto the fixing belt module 61 acting as the heating member. A fourth exemplary embodiment is described on the fixing device, which is configured so that a fixing belt supported at its two end portions to turn and having the heat source pressed from the inside is used as the heating member, and so that the pressure roll is pressed as the pressure member onto the fixing belt. Here, structures similar to those of the first embodiment are designated by similar reference numerals, and their detailed descriptions are omitted.

Figure 12:
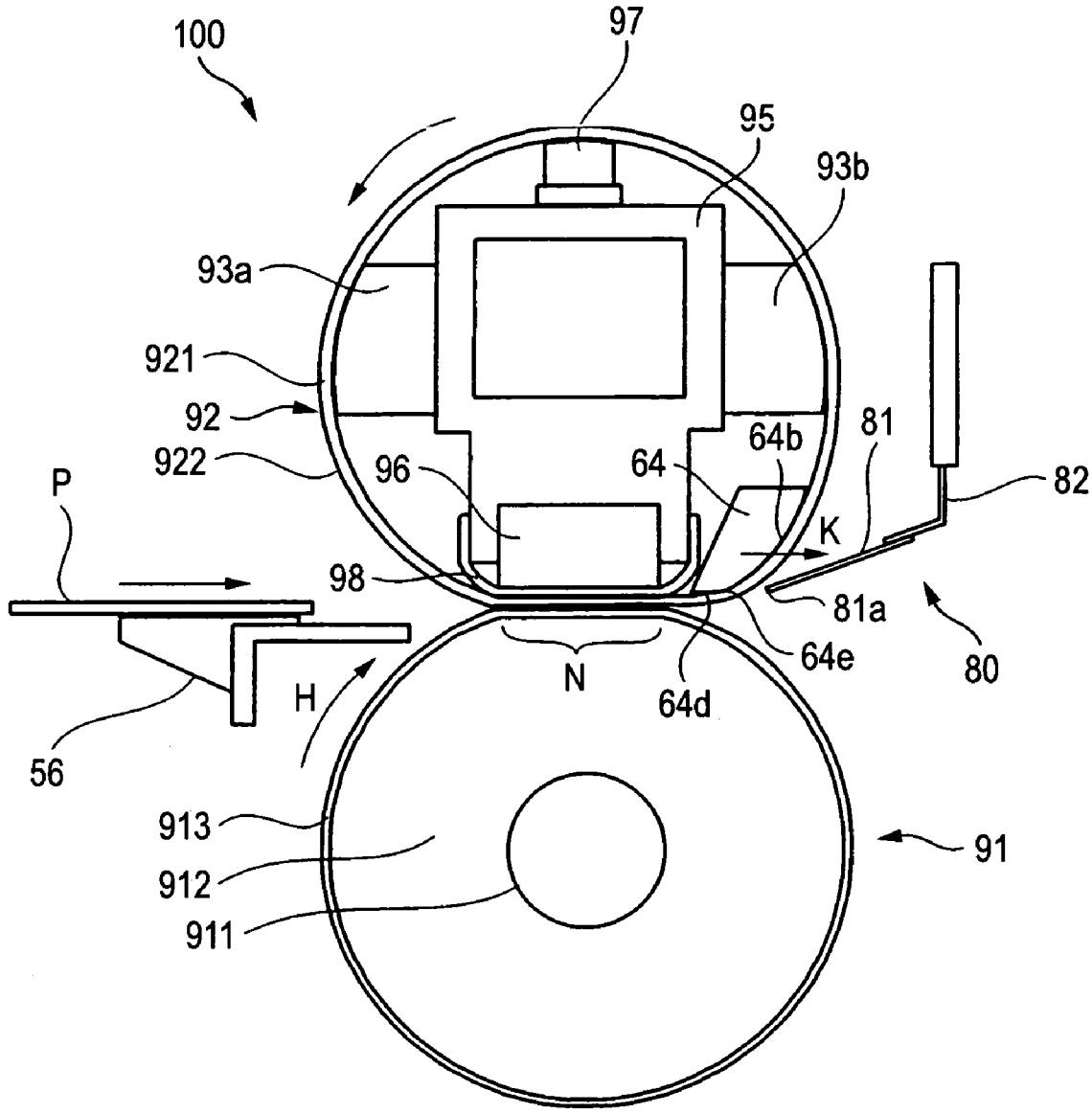
FIG. 12 is a side cross section showing a schematic configuration of a fixing device according to a fourth exemplary embodiment.

FIG. 12 is a side cross section showing the configuration of a fixing device 100 in this embodiment. In the fixing device 100 of this embodiment, as shown in FIG. 12, a fixing belt 92 is arranged as one example of the belt member on the side of the toner image carrying face of the paper sheet P. On the inner side of the fixing belt 92, there is arranged a ceramic heater 96 acting as a resistance heater for one example of the heat source thereby to feed the nip portion N with the heat. On the downstream side of the nip portion N, moreover, there is arranged the peel pad 64 for subjecting the paper sheet P to the curvature separation.

The fixing belt 92 is an endless belt member having an original shape formed into a cylindrical shape, and is composed of: a base layer 921 made of a thermoset polyimide resin, a thermoplastic polyimide resin, a poly-amide-imide resin or a polybenzimidazole resin, or a metallic film of SUS; and a peeling layer 922 coated on its surface (i.e., the outer circumference) of the base layer 921 on the side of the pressure roll 91 or on its both surfaces with a fluorine resin or the like.

Moreover, the fixing belt 92 is turnably supported by the ceramic heater 96 arranged in its inside, an upstream side belt guide member 93*a* and a downstream side belt guide member 93*b*, and the (not-shown) edge guide members arranged on the two end portions of the fixing belt 92. This fixing belt 92 is so arranged and pressed at the nip portion N onto the pressure roll 91 as to turn while following the pressure roll 91. At this time, the fixing belt 92 is so limited by the edge guide members at the two widthwise end portions as is limited in its widthwise shifts (or the belt walks), thereby to suppress the offset of the fixing belt 92.

Here, the ceramic heater 96, the upstream side belt guide member 93*a*, the downstream side belt guide member 93*b* and the edge guide members are supported altogether by a support holder 95, which is arranged in the fixing belt 92. On the other hand, the support holder 95 is provided with an oil applying pad 97 for applying a lubricant such as amino-modified silicone oil to the inner periphery of the fixing belt 92.

The ceramic heater 96 is formed to have a substantially flat face on the side of the pressure roll 91. Moreover, the ceramic heater 96 is arranged and pressed by the pressure roll 91 through the fixing belt 92 thereby to form the nip portion N. Therefore, the ceramic heater 96 also functions as the pressure member.

Between the inner periphery of the fixing belt 92 and the ceramic heater 96, moreover, there is arranged a low-friction sheet 98 acting as one example of the sliding member for reducing the sliding resistance between the inner periphery of the fixing belt 92 and the ceramic heater 96. The low-friction sheet 98 may be formed either separately of or integrally with the ceramic heater 96.

On the downstream side of the nip portion N, on the other hand, there is arranged the peeling pad 64 acting as the peeling member for bending the advancing direction of the fixing belt 92 abruptly thereby to change the curvature of the same.

On the other hand, the pressure roll 91 is arranged as one example of the pressure member to confront the fixing belt 92, and is rotated in the direction of arrow H by the not-shown drive motor. The pressure roll 91 is configured by laminating a core (or a cylindrical core) 911, a refractory elastic layer 912 coating the outer circumference of the core 911, and a peeling layer 913 made of a refractory resin coating or a refractory rubber coating.

Moreover, the paper sheet P, to which the toner image is electrostatically transferred at the secondary transfer unit 20 of the image forming apparatus shown in FIG. 1, is guided into the nip portion N of the fixing device 100 by the fixing entry guide 56. When the paper sheet P passes through the nip portion N, the toner image on the paper sheet P is fixed by the pressure acting on the nip portion N and the heat fed from the ceramic heater 96 on the side of the fixing belt 92. In the fixing device 100 of this embodiment, too, the nip portion N can be widely retained between the pressure roll 91 and the ceramic heater 96 thereby to retain the stable fixing performance.

The paper sheet P having passed through the nip portion N is peeled off the fixing belt 92 by the peeling pad 64 arranged on the downstream side of the nip portion N.

Here, the peeling pad 64 of this embodiment is formed like that of the first embodiment, and is formed to have the outer side face 64*b* for abruptly changing the advancing direction of the fixing belt 92 having passed through the nip portion N, and a support face 64*d* for supporting the fixing belt 92 just having passed through the nip portion N, from the inner periphery side. Moreover, the peeling pad 64 is set so that its outer side face 64*b* may push the fixing belt 92 in the moving direction (as indicated by arrow K) of the paper sheet P. As a result, the fixing belt 92 having passed through the nip portion N moves along the outer side face 64*b* of the peeling pad 64 so that its curvature abruptly changes at a ridge 64*e* of the boundary between the outer side face 64*b* of the peeling pad 64 and the support face 64*d*.

Moreover, the peeling pad 64 has its outer side face 64*b* set so that the fixing belt 92 having passed through the nip portion N may move to draw different loci (or bent shapes) at the central portion and the two end portions of the peeling pad 64 in the longitudinal direction. Specifically, the ridge (i.e., the edge portion for bending the advancing direction of the fixing belt 92 abruptly) of the boundary between the outer side face 64*b* and the support face 64*d* of the peeling pad 64 is formed of the curved profile, which is curved more upstream at the longitudinal middle portion in the moving direction of the fixing belt 92 than the two end portions. With this configuration, the fixing belt 92 to move along the outer side face 64*b* changes, just after it passed through the nip portion N, the moving direction the earliest at the longitudinal middle portion. After this, the fixing belt 92 changes the moving direction sequentially toward the two longitudinal end portions. As a result, the paper sheet P having stuck to the fixing belt 92 is peeled at first at the widthwise middle portion and then gradually toward its two widthwise end portions.

Moreover, the ridge 64*e* of the peeling pad 64 should not be limited to the aforementioned curved profile but can also be formed with the straight profile such that the inclination angle is made larger at the longitudinal middle portion of the outer side face 64*b* than at the two end portions.

Thus, the fixing belt 92 having passed through the nip portion N is set so set by the peeling pad 64 as to move while drawing different bent shapes at the middle portion and the two end portions of the peeling pad 64 in the longitudinal direction, so that the "timely deviation" can be caused in the peel of the leading end portion of the paper sheet P from the fixing belt 92. Therefore, the sticking force can be timely dispersed between the paper sheet P and the fixing belt 92 at the leading end portion of the paper sheet P. As a result, the peeling performance at the downstream portion of the nip portion N can be improved to subject the paper sheet P stably to the curvature separation from the fixing belt 92.

Figure 13:
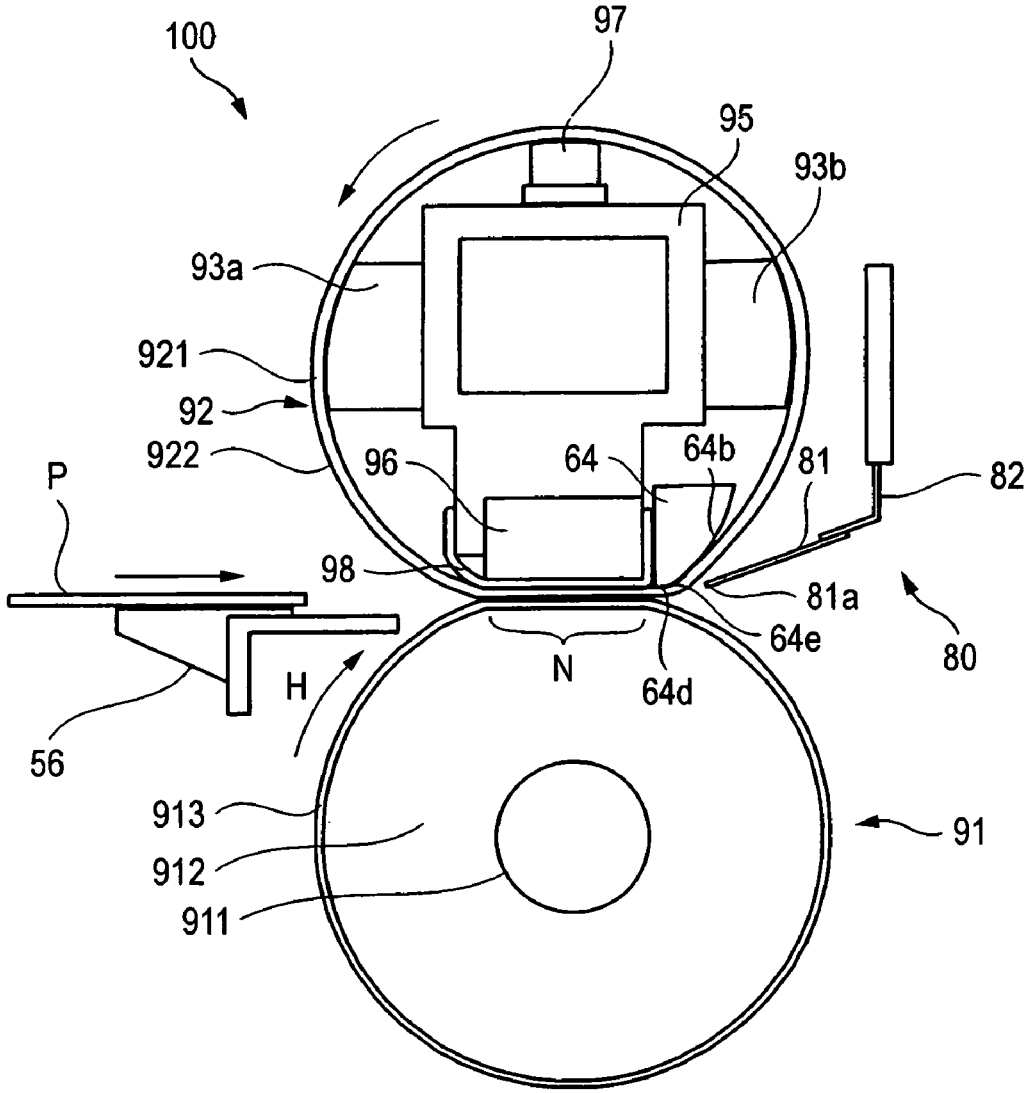
FIG. 13 is a side cross section showing a configuration, in which a peeling pad is arranged close to the exit of a nip portion.

As shown in FIG. 13, the structure can also be modified so that the peeling pad 64 is arranged close to the downstream side of the nip portion N (or the exit of the nip portion N). Thus, the peeling pad 64 peels (for the curvature separation) the paper sheet P just having left the nip portion N off the fixing belt 92 so that the peeling position of the paper sheet P can be stabilized at the ridge 64*e* of the peeling pad 64. Depending upon the image density on the paper sheet P, more specifically, in the route from the nip portion N to the peeling pad 64, there may occur the phenomenon that the paper sheet P is partially peeled off the fixing belt 92. By arranging the peeling pad 64 close to the exit of the nip portion N, however, the contact between the paper sheet P and the fixing belt 92 can be kept up to the position of the ridge 64*e*. As a result, the homogeneity of the image luster can be kept. In this point, it is preferred to arrange the peeling pad 64 close to the exit of the nip portion N.

Here, a peel guide plate 80 can also be arranged as the peel guide member for aiding the peel on the downstream side of the nip portion N of the fixing belt 92. The peel guide plate 80 is so held by a holder 82 that a peeling baffle 81 is close to the fixing belt 92 in the direction (i.e., the counter direction) opposed to the turning direction of the fixing belt 92. In order to scoop the widthwise middle portion of the paper sheet P peeled at first off the fixing belt 92 by the peeling pad 64, moreover, the peeling baffle 81 is formed so that its edge face 81*a* on the side of the nip portion N is curved convex at its longitudinal middle portion on the side of the nip portion N.

By thus combining the peeling pad 64 and the peel guide plate 80, the peeling performance can be further enhanced to the thin coated paper having no nerve, especially the coated paper having absorbed the moisture under a highly humid environment.

INDUSTRIAL APPLICABILITY

The application of the present invention is exemplified by the application to the image forming apparatus such as a copier or a printer using the electronic photography method, or the application to a fixing device for fixing an unfixed toner image on recording paper (or a form sheet). Another is the application to the image forming apparatus such as a copier or a printer using the ink jet method, or the application to a fixing device for drying an undried ink image on the recording paper (or the form sheet).

As described so far, according to an aspect of the present invention, a fixing device for fixing a toner image on a recording material, includes a rotatable endless belt member, a pressure member provided to press into contact and form a nip portion with the belt member, through which the recording material passes, and a peeling member provided downstream of the nip portion, peeling the recording material passed through the nip portion from the belt member by bending the belt member to have different shapes at a widthwise middle portion and at both end portions while the belt member is passing through the peeling member.

The peeling member may bend the belt member earlier at the widthwise middle portion than at the both end portions.

The peeling member may bend the belt member at a larger angle at the widthwise middle portion than at the both end portions.

The fixing device may further include an adjusting member provided downstream of the bending member, compensating a route difference in a widthwise direction of the belt member.

The fixing device may further include a guide member provided downstream of the peeling member, guiding the recording material having exited the peeling member, the guide member being formed to protrude at a middle portion, in a direction parallel to the widthwise direction of the belt member, towards the peeling member than both end portions thereof.

A heat source may be disposed inside the belt member.

According to another aspect of the present invention, a fixing device for fixing a toner image on a recording material, includes a rotatable endless belt member, a pressure member provided to press into contact and form a nip portion with the belt member, through which the recording material passes, and a peeling member provided downstream of the nip portion, peeling the recording material passed through the nip portion from the belt member with a time difference between a widthwise middle portion and both end portions of the belt member.

According to still another aspect of the present invention, a fixing device for fixing a toner image on a recording material, includes a fixing roll, a belt member wound around the fixing roll to be kept under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member with a time difference between a widthwise middle portion and the both end portions of the belt member.

The peeling member may be made of a block member formed to have a substantially arcuate cross section.

The peeling member may peel the recording material from the belt member earlier at the widthwise middle portion than at the both end portions of the belt member.

The peeling member may include a pressure surface which presses the pressure member through the belt member, and a peeling surface which is positioned on an opposite side of the fixing roll, and changes an advancing direction of the belt material.

The peeling surface may have a larger inclination angle at a middle portion of the peeling member, in a direction parallel to the widthwise direction of the belt member, than at both end portions of the peeling member.

An upstream side end portion of the pressure surface may be arranged in a wedge-shaped area between the fixing roll and the pressure member.

A nip pressure Pn in an intermediate area between the nip portion of the fixing roll and the pressure member and a pressed contact portion of the pressure member and the peeling member may satisfy the following relation with an absolute temperature Tn of the belt member, an absolute temperature To of a surrounding environment, and an atmospheric pressure Po:

$$Pn \geqq Po \times (Tn/To - 1).$$

The fixing roll may include a heat source therein.

According to still another aspect of the present invention, a fixing device for fixing a toner image on a recording material, includes a fixing roll, a belt member wound around the fixing roll to be kept under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member by bending the belt member to have different shapes at a widthwise middle portion and at both end portions while the belt member is passing through the peeling member.

According to still another aspect of the present invention, an image forming apparatus includes a toner image forming section which forms a toner image, a transfer section which transfers the toner image formed by the toner image forming section onto a recording material, and a fixing section which fixes the toner image transferred onto the recording material on the recording material. The fixing section includes a fixing roll, a belt member wound around the fixing roll under tension, a pressure member provided to press towards the fixing roll and form a nip portion with the belt member wound around the fixing roll, through which the recording material passes, and a peeling member provided between the fixing roll and the belt member downstream and in the vicinity of the nip portion, pressing the belt member against the pressure member to peel the recording material passed through the nip portion from the belt member with a time difference between a widthwise middle portion and the both end portions of the belt member.

A nip pressure of an area from the most downstream portion of the nip portion between the fixing roll and the pressure member to the most downstream portion of a pressed contact portion between the pressure member and the peeling member may be monotonically decreasing in an advancing direction of the belt member.

The pressure member of the fixing section may be formed of a roll member.

The pressure member of the fixing section may be formed of a pressure belt module, in which the belt member is wound around plural tension rolls to be kept under tension.

The pressure belt module may include a non-rotatable pressure member which presses the fixing roll through the belt member.

The belt member may be wound around the fixing roll and one or more tension rolls other than the fixing roll to be kept under tension, and at least one of the fixing roll and the tension rolls may have a heat source therein.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device for fixing a toner image on a recording material, comprising:

a rotatable endless belt member;

a pressure member provided to press into contact and form a nip portion with the belt member, through which the recording material passes; and a peeling member provided downstream of the nip portion, peeling the recording material passed through the nip portion from the belt member, wherein the peeling member peels the recording material from the belt member earlier at the widthwise middle portion than at the both end portions of the belt member.

2. The fixing device according to claim 1, wherein the peeling member bends the belt member earlier at the widthwise middle portion than at the both end portions.

3. The fixing device according to claim 1, wherein the peeling member bends the belt member at a larger angle at the widthwise middle portion than at the both end portions.

4. The fixing device according to claim 1, further comprising:

an adjusting member provided downstream of the peeling member, compensating a route difference in a widthwise direction of the belt member.

5. The fixing device according to claim 1, further comprising;

a guide member provided downstream of the peeling member, guiding the recording material having exited the peeling member, the guide member being formed to protrude at a middle portion, in a direction parallel to the widthwise direction of the belt member, more towards the peeling member than both end portions thereof.

6. The fixing device according to claim 1, wherein a heat source is disposed inside the belt member.

7. A fixing device for fixing a toner image on a recording material, comprising:

a rotatable endless belt member;

a pressure member provided to press into contact and form a nip portion with the belt member, through which the recording material passes; and a peeling member provided downstream of the nip portion, peeling the recording material passed through the nip portion from the belt member, wherein the peeling member peels the recording material from the belt member earlier at the widthwise middle portion than at the both end portions of the belt member.

8. A fixing device for fixing a toner image on a recording material, comprising:

a fixing roll;

a belt member wound around the fixing roll to be kept under tension;

a pressure member provided to press towards the fixing roll and form a nip portion with the belt member wound around the fixing roll, through which the recording material passes; and a peeling member provided between the fixing roll and the belt member downstream and in the vicinity of the nip portion, pressing the belt member against the pressure member to peel the recording material passed through the nip portion from the belt member, wherein the peeling member peels the recording material from the belt member earlier at the widthwise middle portion than at the both end portions of the belt member.

9. The fixing device according to claim 8, wherein the peeling member is made of a block member formed to have a substantially arcuate cross section.

10. The fixing device according to claim 8, wherein the peeling member includes:

a pressure surface which presses the pressure member through the belt member; and a peeling surface which is positioned on an opposite side of the belt from the fixing roll, and changes an advancing direction of the belt member.

11. The fixing device according to claim 10, wherein the peeling surface has a larger inclination angle at a middle portion of the peeling member, in a direction parallel to the widthwise direction of the belt member, than at both end portions of the peeling member.

12. The fixing device according to claim 10, wherein an upstream side end portion of the pressure surface is arranged in a wedge-shaped area between the fixing roll and the pressure member.

13. The fixing device according to claim 8, wherein a nip pressure Pn in an intermediate area between the nip portion of the fixing roll and the pressure member and a pressed contact portion of the pressure member and the peeling member satisfies the following relation with an absolute temperature Tn of the belt member, an absolute temperature To of a surrounding environment, and an atmospheric pressure Po:

$$(Tn/To-1)\cdot P_n \geqq P_o \times (T_n/T-1).$$

14. The fixing device according to claim 8, wherein the fixing roll includes a heat source therein.

15. A fixing device for fixing a toner image on a recording material, comprising:

a fixing roll;

a belt member wound around the fixing roll to be kept under tension;

a pressure member provided to press towards the fixing roll and form a nip portion with the belt member wound around the fixing roll, through which the recording material passes; and a peeling member provided between the fixing roll and the belt member downstream and in the vicinity of the nip portion, pressing the belt member against the pressure member to peel the recording material passed through the nip portion from the belt member, wherein the peeling member peels the recording material from the belt member earlier at the widthwise middle portion than at the both end portions of the belt member.

16. An image forming apparatus, comprising:

a toner image forming section which forms a toner image;

a transfer section which transfers the toner image formed by the toner image forming section onto a recording material; and a fixing section which fixes the toner image transferred onto the recording material on the recording material, the fixing section comprising:

a fixing roll;

a first belt member wound around the fixing roll to be kept under tension;

a pressure member provided to press towards the fixing roll and form a nip portion with the first belt member wound around the fixing roll, through which the recording material passes; and a peeling member provided between the fixing roll and the first belt member downstream and in the vicinity of the nip portion, pressing the first belt member against the pressure member to peel the recording material passed through the nip portion from the first belt member, wherein the peeling member peels the recording material from the belt member earlier at the widthwise middle portion than at the both end portions of the belt member.

17. The image forming apparatus according to claim 16, wherein a nip pressure of an area from the most downstream portion of the nip portion between the fixing roll and the pressure member to the most downstream portion of a pressed contact portion between the pressure member and the peeling member is monotonically decreasing in an advancing direction of the belt member.

18. The image forming apparatus according to claim 16, wherein the pressure member of the fixing section is formed of a roll member.

19. The image forming apparatus according to claim 16, wherein the pressure member of the fixing section is formed of a pressure belt module, in which a second belt member is wound around a plurality of tension rolls to be kept under tension.

20. The image forming apparatus according to claim 19, wherein the pressure belt module includes a non-rotatable pressure member which presses the fixing roll through the second belt member.

21. The image forming apparatus according to claim 16, wherein the first belt member is wound around the fixing roll and one or more tension rolls other than the fixing roll to be kept under tension, and at least one of the fixing roll and the tension rolls has a heat source therein.

* * * * *